US011801186B2

(12) United States Patent
Kulkarni et al.

(10) Patent No.: US 11,801,186 B2
(45) Date of Patent: Oct. 31, 2023

(54) URINE STORAGE CONTAINER HANDLE AND LID ACCESSORIES

(71) Applicant: PureWick Corporation, El Cajon, CA (US)

(72) Inventors: Vinayaka Kulkarni, Bangalore (IN); Claire Gloeckner, Lilburn, GA (US); Seth Schneider, Social Circle, GA (US); Hannah Rose Kriscovich, Marietta, GA (US)

(73) Assignee: PUREWICK CORPORATION, El Cajon, CA (US)

( * ) Notice: Subject to any disclaimer, the term of this patent is extended or adjusted under 35 U.S.C. 154(b) by 0 days.

(21) Appl. No.: 17/461,036

(22) Filed: Aug. 30, 2021

(65) Prior Publication Data

US 2022/0071826 A1 Mar. 10, 2022

Related U.S. Application Data

(60) Provisional application No. 63/076,477, filed on Sep. 10, 2020.

(51) Int. Cl.
*A61G 9/00* (2006.01)
*A61G 9/02* (2006.01)

(52) U.S. Cl.
CPC ..... *A61G 9/006* (2013.01); *A61G 9/02* (2013.01)

(58) Field of Classification Search
CPC ..... A61G 9/006; A61G 9/02
USPC ..... 4/144.1
See application file for complete search history.

(56) References Cited

U.S. PATENT DOCUMENTS

| | | | |
|---|---|---|---|
| 670,602 | A | 3/1901 | Baker |
| 1,032,841 | A | 7/1912 | Koenig |
| 1,178,644 | A | 4/1916 | Johnson |
| 1,742,080 | A | 12/1929 | Jones |
| 1,979,899 | A | 11/1934 | Obrien et al. |
| 2,326,881 | A | 8/1943 | Packer |
| 2,379,346 | A | 6/1945 | Farrell |
| 2,613,670 | A | 10/1952 | Edward |
| 2,616,426 | A | 11/1952 | Adele |
| 2,644,234 | A | 7/1953 | Earl |

(Continued)

FOREIGN PATENT DOCUMENTS

| | | | |
|---|---|---|---|
| AU | 2018216821 | A1 | 8/2019 |
| CA | 2165286 | C | 9/1999 |

(Continued)

OTHER PUBLICATIONS

US 9,908,683 B2, 03/2018, Sandhausen et al. (withdrawn)

(Continued)

*Primary Examiner* — Huyen D Le
(74) *Attorney, Agent, or Firm* — DORSEY & WHITNEY LLP

(57) ABSTRACT

Example urine storage assemblies and systems for storing and disposing urine are described. The assembly includes a urine storage container, a lid, and a handle accessory. The lid is secured or securable to an open end of the urine storage container. The lid includes a vacuum port, a urine collection port, a urine disposal port, and a cap secured or securable to the urine disposal port. The handle accessory includes a sleeve and at least one handle. The sleeve is shaped and sized complimentary to at least a portion of the urine storage container.

35 Claims, 13 Drawing Sheets

(56) References Cited

U.S. PATENT DOCUMENTS 2,859,786 A 11/1958 Tupper
2,968,046 A 1/1961 Duke
2,971,512 A 2/1961 Reinhardt
3,032,038 A 5/1962 Swinn
3,077,883 A 2/1963 Hill
3,087,938 A 4/1963 Hans et al.
3,198,994 A 8/1965 Hildebrandt et al.
3,221,742 A 12/1965 Egon
3,312,981 A 4/1967 Mcguire et al.
3,349,768 A 10/1967 Keane
3,362,590 A 1/1968 Gene
3,366,116 A 1/1968 Huck
3,398,848 A 8/1968 Donovan
3,400,717 A 9/1968 Bruce et al.
3,406,688 A 10/1968 Bruce
3,424,163 A 1/1969 Gravdahl
3,425,471 A 2/1969 Yates
3,511,241 A 5/1970 Lee
3,512,185 A 5/1970 Ellis
3,520,300 A 7/1970 Flower
3,528,423 A 9/1970 Lee
3,613,123 A 10/1971 Langstrom
3,648,700 A 3/1972 Warner
3,651,810 A 3/1972 Ormerod
3,661,155 A 5/1972 Lindan
3,699,815 A 10/1972 Holbrook
3,726,277 A 4/1973 Hirschman
3,757,355 A 9/1973 Allen et al.
3,843,016 A 10/1974 Bornhorst et al.
3,863,638 A 2/1975 Rogers et al.
3,863,798 A 2/1975 Kurihara et al.
3,881,486 A 5/1975 Fenton
3,915,189 A 10/1975 Holbrook et al.
3,998,228 A 12/1976 Poidomani
3,999,550 A 12/1976 Martin
4,015,604 A 4/1977 Csillag
4,020,843 A 5/1977 Kanall
4,022,213 A 5/1977 Stein
4,027,776 A 6/1977 Douglas
4,180,178 A 12/1979 Turner
4,187,953 A 2/1980 Turner
4,194,508 A 3/1980 Anderson
4,200,102 A 4/1980 Duhamel et al.
4,202,058 A 5/1980 Anderson
4,233,025 A 11/1980 Larson et al.
4,233,978 A 11/1980 Hickey
4,246,901 A 1/1981 Frosch et al.
4,257,418 A 3/1981 Hessner
4,270,539 A 6/1981 Frosch et al.
4,292,916 A 10/1981 Bradley et al.
4,352,356 A 10/1982 Tong
4,360,933 A 11/1982 Kimura et al.
4,365,363 A 12/1982 Windauer
4,387,726 A 6/1983 Denard
4,425,130 A 1/1984 Desmarais
4,446,986 A 5/1984 Bowen et al.
4,453,938 A 6/1984 Brendling
4,457,314 A 7/1984 Knowles
4,476,879 A 10/1984 Jackson
4,526,688 A 7/1985 Schmidt et al.
4,528,703 A 7/1985 Kraus
D280,438 S 9/1985 Wendt
4,551,141 A 11/1985 Mcneil
4,553,968 A 11/1985 Komis
4,581,026 A 4/1986 Schneider
4,610,675 A 9/1986 Triunfol
4,620,333 A 11/1986 Ritter
4,626,250 A 12/1986 Schneider
4,627,846 A 12/1986 Ternstroem
4,631,061 A 12/1986 Martin
4,650,477 A 3/1987 Johnson
4,656,675 A 4/1987 Fajnsztajn
4,681,570 A 7/1987 Dalton
4,692,160 A 9/1987 Nussbaumer
4,707,864 A 11/1987 Ikematsu et al.
4,713,066 A 12/1987 Komis
4,747,166 A 5/1988 Kuntz
4,752,944 A 6/1988 Conrads et al.
4,769,215 A 9/1988 Ehrenkranz
4,772,280 A 9/1988 Rooyakkers
4,790,830 A 12/1988 Hamacher
4,790,835 A 12/1988 Elias
4,791,686 A 12/1988 Taniguchi et al.
4,795,449 A 1/1989 Schneider et al.
4,798,603 A 1/1989 Meyer et al.
4,799,928 A 1/1989 Crowley
4,804,377 A 2/1989 Hanifl et al.
4,812,053 A 3/1989 Bhattacharjee
4,820,297 A 4/1989 Kaufman et al.
4,846,818 A 7/1989 Keldahl et al.
4,846,909 A 7/1989 Klug et al.
4,865,595 A 9/1989 Heyden
4,882,794 A 11/1989 Stewart
4,883,465 A 11/1989 Brennan
4,886,508 A 12/1989 Washington
4,886,509 A 12/1989 Mattsson
4,889,532 A 12/1989 Metz et al.
4,889,533 A 12/1989 Beecher
4,903,254 A 2/1990 Haas
4,905,692 A 3/1990 More
4,936,838 A 6/1990 Cross et al.
4,955,922 A 9/1990 Terauchi
4,957,487 A 9/1990 Gerow
4,965,460 A 10/1990 Tanaka et al.
4,987,849 A 1/1991 Sherman
5,002,541 A 3/1991 Conkling et al.
5,004,463 A 4/1991 Nigay
5,031,248 A 7/1991 Kemper
5,045,077 A 9/1991 Blake
5,045,283 A 9/1991 Patel
5,049,144 A 9/1991 Payton
5,053,339 A 10/1991 Patel
5,058,088 A 10/1991 Haas et al.
5,071,347 A 12/1991 Mcguire
5,084,037 A 1/1992 Barnett
5,100,396 A 3/1992 Zamierowski
5,147,301 A 9/1992 Ruvio
5,195,997 A 3/1993 Carns
5,203,699 A 4/1993 Mcguire
5,244,458 A 9/1993 Takasu
5,246,454 A 9/1993 Peterson
5,267,988 A 12/1993 Farkas
5,275,307 A 1/1994 Freese
5,294,983 A 3/1994 Ersoz et al.
5,295,983 A 3/1994 Kubo
5,300,052 A 4/1994 Kubo
5,312,383 A 5/1994 Kubalak
5,318,550 A 6/1994 Cermak et al.
5,340,840 A 8/1994 Park et al.
5,382,244 A 1/1995 Telang
5,423,784 A 6/1995 Metz
5,466,229 A 11/1995 Elson et al.
5,478,334 A 12/1995 Bernstein
5,499,977 A 3/1996 Marx
5,543,042 A 8/1996 Filan et al.
D373,928 S 9/1996 Green
5,605,161 A 2/1997 Cross
5,618,277 A 4/1997 Goulter
5,628,735 A 5/1997 Skow
5,636,643 A 6/1997 Argenta et al.
5,637,104 A * 6/1997 Ball ..... B65D 39/10 604/905
5,674,212 A 10/1997 Osborn et al.
5,678,564 A 10/1997 Lawrence et al.
5,678,654 A 10/1997 Uzawa
5,687,429 A 11/1997 Rahlff
5,695,485 A 12/1997 Duperret et al.
5,752,944 A 5/1998 Dann et al.
5,772,644 A 6/1998 Bark et al.
5,827,243 A 10/1998 Palestrant
5,827,247 A 10/1998 Kay
5,827,250 A 10/1998 Fujioka et al.
5,827,257 A 10/1998 Fujioka et al.
D401,699 S 11/1998 Herchenbach et al.

(56) References Cited

U.S. PATENT DOCUMENTS 5,865,378 A 2/1999 Hollinshead et al.
5,887,291 A 3/1999 Bellizzi
5,894,608 A 4/1999 Birbara
D409,303 S 5/1999 Oepping
5,911,222 A 6/1999 Lawrence et al.
5,957,904 A 9/1999 Holland
5,972,505 A 10/1999 Phillips et al.
6,050,983 A 4/2000 Moore et al.
6,059,762 A 5/2000 Boyer et al.
6,063,064 A 5/2000 Tuckey et al.
6,098,625 A 8/2000 Winkler
6,105,174 A 8/2000 Karlsten et al.
6,113,582 A 9/2000 Dwork
6,117,163 A 9/2000 Bierman
6,123,398 A 9/2000 Arai et al.
6,129,718 A 10/2000 Wada et al.
6,131,964 A 10/2000 Sareshwala
6,152,902 A 11/2000 Christian et al.
6,164,569 A 12/2000 Hollinshead et al.
6,177,606 B1 1/2001 Etheredge et al.
6,209,142 B1 4/2001 Mattsson et al.
6,248,096 B1 6/2001 Dwork et al.
6,263,887 B1 7/2001 Dunn
6,311,339 B1 11/2001 Kraus
6,336,919 B1 1/2002 Davis et al.
6,338,729 B1 1/2002 Wada et al.
6,352,525 B1 3/2002 Wakabayashi
6,406,463 B1 * 6/2002 Brown ..... A61G 9/006 4/144.1
6,409,712 B1 6/2002 Dutari et al.
6,416,500 B1 7/2002 Wada et al.
6,428,521 B1 8/2002 Droll
6,475,198 B1 11/2002 Lipman et al.
6,479,726 B1 11/2002 Cole et al.
6,491,673 B1 12/2002 Palumbo et al.
6,508,794 B1 1/2003 Palumbo et al.
6,540,729 B1 4/2003 Wada et al.
6,547,771 B2 4/2003 Robertson et al.
6,569,133 B2 5/2003 Cheng et al.
D476,518 S 7/2003 Doppelt
6,592,560 B2 7/2003 Snyder et al.
6,618,868 B2 9/2003 Minnick
6,620,142 B1 9/2003 Flueckiger
6,629,651 B1 10/2003 Male et al.
6,635,038 B2 10/2003 Scovel
6,652,495 B1 11/2003 Walker
6,685,684 B1 2/2004 Falconer
6,702,793 B1 3/2004 Sweetser et al.
6,706,027 B2 3/2004 Harvie et al.
6,732,384 B2 5/2004 Scott
6,736,977 B1 5/2004 Hall et al.
6,740,066 B2 5/2004 Wolff et al.
6,764,477 B1 7/2004 Chen et al.
6,783,519 B2 8/2004 Samuelsson
6,796,974 B2 9/2004 Palumbo et al.
6,814,547 B2 11/2004 Childers et al.
6,849,065 B2 2/2005 Schmidt et al.
6,857,137 B2 2/2005 Otto
6,885,690 B2 4/2005 Aggerstam et al.
6,888,044 B2 5/2005 Fell et al.
6,893,425 B2 5/2005 Dunn et al.
6,912,737 B2 7/2005 Ernest et al.
6,918,899 B2 7/2005 Harvie
6,979,324 B2 12/2005 Bybordi et al.
7,018,366 B2 3/2006 Easter
7,066,411 B2 6/2006 Male et al.
7,125,399 B2 10/2006 Miskie
7,131,964 B2 11/2006 Harvie
7,135,012 B2 11/2006 Harvie
7,141,043 B2 11/2006 Harvie
D533,972 S 12/2006 La
7,160,273 B2 1/2007 Greter et al.
7,171,699 B2 2/2007 Ernest et al.
7,171,871 B2 2/2007 Kozak
7,179,951 B2 2/2007 Krishnaswamy-mirle et al.
7,181,781 B1 2/2007 Trabold et al.
7,186,245 B1 3/2007 Cheng et al.
7,192,424 B2 3/2007 Cooper
7,220,250 B2 5/2007 Suzuki et al.
D562,975 S 2/2008 Otto
7,335,189 B2 2/2008 Harvie
7,358,282 B2 4/2008 Krueger et al.
7,390,320 B2 6/2008 Machida et al.
7,438,706 B2 10/2008 Koizumi et al.
7,488,310 B2 2/2009 Yang
7,491,194 B1 2/2009 Oliwa
D591,106 S 4/2009 Dominique et al.
7,513,381 B2 4/2009 Heng et al.
7,520,872 B2 4/2009 Biggie et al.
D593,801 S 6/2009 Wilson et al.
7,540,364 B2 6/2009 Sanderson
7,585,293 B2 9/2009 Vermaak
7,588,560 B1 9/2009 Dunlop
7,665,359 B2 2/2010 Barber
7,682,347 B2 3/2010 Parks et al.
7,687,004 B2 3/2010 Allen
7,695,459 B2 4/2010 Gilbert et al.
7,695,460 B2 4/2010 Wada et al.
7,699,818 B2 4/2010 Gilbert
7,699,831 B2 4/2010 Bengtson et al.
7,722,584 B2 5/2010 Tanaka et al.
7,727,206 B2 6/2010 Gorres
7,740,620 B2 6/2010 Gilbert et al.
7,749,205 B2 7/2010 Tazoe et al.
7,755,497 B2 7/2010 Wada et al.
7,766,887 B2 8/2010 Burns et al.
D625,407 S 10/2010 Koizumi et al.
7,806,879 B2 10/2010 Brooks et al.
7,815,067 B2 10/2010 Matsumoto et al.
7,833,169 B2 11/2010 Hannon
7,857,806 B2 12/2010 Karpowicz et al.
7,866,942 B2 1/2011 Harvie
7,871,385 B2 1/2011 Levinson et al.
7,875,010 B2 1/2011 Frazier et al.
7,901,389 B2 3/2011 Mombrinie
7,927,320 B2 4/2011 Goldwasser et al.
7,927,321 B2 4/2011 Marland
7,931,634 B2 4/2011 Swiecicki et al.
7,939,706 B2 5/2011 Okabe et al.
7,946,443 B2 5/2011 Stull et al.
7,947,025 B2 5/2011 Buglino et al.
7,963,419 B2 6/2011 Burney et al.
7,976,519 B2 7/2011 Bubb et al.
7,993,318 B2 8/2011 Olsson et al.
8,015,627 B2 * 9/2011 Baker ..... A61G 9/00 4/144.1
8,028,460 B2 10/2011 Williams
8,047,398 B2 11/2011 Dimartino et al.
8,083,094 B2 12/2011 Caulfield et al.
8,128,608 B2 3/2012 Thevenin
8,181,651 B2 5/2012 Pinel
8,181,819 B2 5/2012 Burney et al.
8,211,063 B2 7/2012 Bierman et al.
8,221,369 B2 7/2012 Parks et al.
8,241,262 B2 8/2012 Mahnensmith
8,277,426 B2 10/2012 Wilcox et al.
8,287,508 B1 10/2012 Sanchez
8,303,554 B2 11/2012 Tsai et al.
8,322,565 B2 12/2012 Caulfield et al.
8,337,477 B2 12/2012 Parks et al.
D674,241 S 1/2013 Bickert et al.
8,343,122 B2 1/2013 Gorres
8,353,074 B2 1/2013 Krebs
8,353,886 B2 1/2013 Bester et al.
D676,241 S 2/2013 Merrill
8,388,588 B2 3/2013 Wada et al.
D679,807 S 4/2013 Burgess et al.
8,425,482 B2 4/2013 Khoubnazar
8,449,510 B2 5/2013 Martini et al.
D684,260 S 6/2013 Lund et al.
8,470,230 B2 6/2013 Caulfield et al.
8,479,941 B2 7/2013 Matsumoto et al.
8,479,949 B2 7/2013 Henkel

(56) References Cited

U.S. PATENT DOCUMENTS 8,512,301 B2 * 8/2013 Ma ..... A61B 10/0291 604/319
8,529,530 B2 9/2013 Koch et al.
8,535,284 B2 9/2013 Joder et al.
8,546,639 B2 10/2013 Wada et al.
8,551,075 B2 10/2013 Bengtson
8,568,376 B2 10/2013 Delattre et al.
D694,404 S 11/2013 Burgess et al.
8,585,683 B2 11/2013 Bengtson et al.
8,586,583 B2 11/2013 Hamblin et al.
8,652,112 B2 2/2014 Johannison et al.
D702,973 S 4/2014 Norland et al.
8,703,032 B2 4/2014 Menon et al.
D704,330 S 5/2014 Cicatelli
D704,510 S 5/2014 Mason et al.
D705,423 S 5/2014 Walsh Cutler
D705,926 S 5/2014 Burgess et al.
8,714,394 B2 5/2014 Wulf
8,715,267 B2 5/2014 Bengtson et al.
8,757,425 B2 6/2014 Copeland
8,777,032 B2 7/2014 Biesecker et al.
8,808,260 B2 8/2014 Koch et al.
8,864,730 B2 10/2014 Conway et al.
8,881,923 B2 11/2014 Higginson
8,936,585 B2 1/2015 Carson et al.
D729,581 S 5/2015 Boroski
9,028,460 B2 5/2015 Medeiros
9,056,698 B2 6/2015 Noer
9,078,792 B2 7/2015 Ruiz
9,173,602 B2 11/2015 Gilbert
9,173,799 B2 11/2015 Tanimoto et al.
9,187,220 B2 11/2015 Biesecker et al.
9,199,772 B2 12/2015 Krippendorf
9,233,020 B2 1/2016 Matsumiya
9,248,058 B2 2/2016 Conway et al.
9,308,118 B1 4/2016 Dupree et al.
9,309,029 B2 4/2016 Incorvia et al.
9,333,281 B2 5/2016 Giezendanner et al.
9,382,047 B2 7/2016 Schmidtner et al.
9,456,937 B2 10/2016 Ellis
9,480,595 B2 11/2016 Baham et al.
9,517,865 B2 12/2016 Albers et al.
D777,941 S 1/2017 Piramoon
9,533,806 B2 1/2017 Ding et al.
9,550,611 B2 1/2017 Hodge
9,555,930 B2 1/2017 Campbell et al.
D789,522 S 6/2017 Burgess et al.
9,687,849 B2 6/2017 Bruno et al.
9,694,949 B2 7/2017 Hendricks et al.
9,788,992 B2 10/2017 Harvie
D804,907 S 12/2017 Sandoval
9,868,564 B2 1/2018 Mcgirr et al.
D814,239 S 4/2018 Arora
D817,484 S 5/2018 Lafond
10,037,640 B2 7/2018 Gordon
10,058,470 B2 8/2018 Phillips
10,098,990 B2 10/2018 Koch et al.
D835,264 S 12/2018 Mozzicato et al.
D835,779 S 12/2018 Mozzicato et al.
D840,533 S 2/2019 Mozzicato et al.
D840,534 S 2/2019 Mozzicato et al.
10,225,376 B2 3/2019 Perez Martinez
10,226,376 B2 3/2019 Sanchez et al.
D848,612 S 5/2019 Mozzicato et al.
10,307,305 B1 6/2019 Hodges
10,335,121 B2 7/2019 Desai
D856,512 S 8/2019 Cowart et al.
10,376,406 B2 8/2019 Newton
10,376,407 B2 8/2019 Newton
10,390,989 B2 8/2019 Sanchez et al.
D858,144 S 9/2019 Fu
10,406,039 B2 9/2019 Villarreal
10,407,222 B2 9/2019 Allen
10,478,356 B2 11/2019 Griffin
10,538,366 B2 1/2020 Pentelovitch et al.
10,569,938 B2 2/2020 Zhao et al.
10,577,156 B2 3/2020 Dagnelie et al.
10,618,721 B2 4/2020 Vazin
D884,390 S 5/2020 Wang
10,669,079 B2 6/2020 Freedman et al.
D892,315 S 8/2020 Airy
10,730,672 B2 8/2020 Bertram et al.
10,737,848 B2 8/2020 Philip et al.
10,765,854 B2 9/2020 Law et al.
10,766,670 B2 9/2020 Kittmann
D901,214 S 11/2020 Hu
10,857,025 B2 12/2020 Davis et al.
10,865,017 B1 12/2020 Cowart et al.
10,889,412 B2 1/2021 West et al.
10,913,581 B2 2/2021 Stahlecker
D912,244 S 3/2021 Rehm et al.
10,952,889 B2 3/2021 Newton et al.
10,973,678 B2 4/2021 Newton et al.
10,974,874 B2 4/2021 Ragias et al.
11,000,401 B2 5/2021 Ecklund et al.
D923,365 S 6/2021 Wang
11,026,829 B2 6/2021 Harvie
11,027,900 B2 6/2021 Liu
11,045,346 B2 6/2021 Argent et al.
D928,946 S 8/2021 Sanchez et al.
11,179,506 B2 11/2021 Barr et al.
11,226,376 B2 1/2022 Yamauchi et al.
11,376,152 B2 7/2022 Sanchez et al.
11,382,786 B2 7/2022 Sanchez et al.
11,426,303 B2 8/2022 Davis et al.
2001/0037097 A1 11/2001 Cheng et al.
2001/0054426 A1 12/2001 Knudson et al.
2002/0019614 A1 2/2002 Woon
2002/0026161 A1 2/2002 Grundke
2002/0087131 A1 7/2002 Wolff et al.
2002/0189992 A1 12/2002 Schmidt et al.
2002/0193760 A1 12/2002 Thompson
2003/0004436 A1 1/2003 Schmidt et al.
2003/0120178 A1 6/2003 Heki
2003/0157859 A1 8/2003 Ishikawa
2003/0181880 A1 9/2003 Schwartz
2003/0195484 A1 10/2003 Harvie
2003/0233079 A1 12/2003 Parks et al.
2004/0006321 A1 1/2004 Cheng et al.
2004/0056122 A1 3/2004 Male et al.
2004/0084465 A1 5/2004 Luburic
2004/0127872 A1 7/2004 Petryk et al.
2004/0128749 A1 * 7/2004 Scott ..... A47K 11/12 4/144.1
2004/0143229 A1 7/2004 Easter
2004/0158221 A1 8/2004 Mizutani et al.
2004/0176731 A1 9/2004 Cheng et al.
2004/0191919 A1 9/2004 Unger et al.
2004/0207530 A1 10/2004 Nielsen
2004/0236292 A1 11/2004 Tazoe et al.
2004/0254547 A1 12/2004 Okabe et al.
2005/0010182 A1 1/2005 Parks et al.
2005/0033248 A1 2/2005 Machida et al.
2005/0070861 A1 3/2005 Okabe et al.
2005/0070862 A1 3/2005 Tazoe et al.
2005/0082300 A1 4/2005 Modrell et al.
2005/0097662 A1 5/2005 Leimkuhler et al.
2005/0101924 A1 5/2005 Elson et al.
2005/0137557 A1 6/2005 Swiecicki et al.
2005/0154360 A1 7/2005 Harvie
2005/0177070 A1 8/2005 Levinson et al.
2005/0197639 A1 9/2005 Mombrinie
2005/0273920 A1 12/2005 Marinas
2005/0277904 A1 12/2005 Chase et al.
2005/0279359 A1 12/2005 LeBlanc et al.
2006/0004332 A1 1/2006 Marx
2006/0015080 A1 1/2006 Mahnensmith
2006/0015081 A1 1/2006 Suzuki et al.
2006/0016778 A1 1/2006 Park
2006/0111648 A1 5/2006 Vermaak
2006/0155214 A1 7/2006 Wightman
2006/0200102 A1 9/2006 Cooper
2006/0229576 A1 10/2006 Conway et al.
2006/0231648 A1 10/2006 Male et al.

(56) References Cited

U.S. PATENT DOCUMENTS

2006/0235359 A1 10/2006 Marland
2006/0277670 A1 12/2006 Baker et al.
2007/0006368 A1 1/2007 Key et al.
2007/0038194 A1 2/2007 Wada et al.
2007/0055209 A1 3/2007 Patel et al.
2007/0117880 A1 5/2007 Elson et al.
2007/0135786 A1 6/2007 Schmidt et al.
2007/0149935 A1 6/2007 Dirico
2007/0191804 A1 8/2007 Coley
2007/0214553 A1 9/2007 Carromba et al.
2007/0225666 A1 9/2007 Otto
2007/0225668 A1 9/2007 Otto
2007/0266486 A1 11/2007 Ramirez
2007/0282309 A1 12/2007 Bengtson et al.
2008/0004576 A1 1/2008 Tanaka et al.
2008/0015526 A1 1/2008 Reiner et al.
2008/0015527 A1 1/2008 House
2008/0033386 A1 2/2008 Okabe et al.
2008/0041869 A1 2/2008 Backaert
2008/0091153 A1 4/2008 Harvie
2008/0091158 A1 4/2008 Yang
2008/0215031 A1 9/2008 Belfort et al.
2008/0234642 A1 9/2008 Patterson et al.
2008/0281282 A1 11/2008 Finger et al.
2008/0287894 A1 11/2008 Van Den Heuvel et al.
2009/0025717 A1 1/2009 Pinel
2009/0048570 A1 2/2009 Jensen
2009/0056003 A1 3/2009 Ivie et al.
2009/0069761 A1 3/2009 Vogel
2009/0069765 A1 3/2009 Wortham
2009/0192482 A1 7/2009 Dodge et al.
2009/0234312 A1 9/2009 Otoole et al.
2009/0251510 A1 10/2009 Noro et al.
2009/0264840 A1 10/2009 Virginio
2009/0270822 A1 10/2009 Medeiros
2009/0281510 A1 11/2009 Fisher
2010/0004612 A1 1/2010 Thevenin
2010/0058660 A1 3/2010 Williams
2010/0121289 A1 5/2010 Parks et al.
2010/0158168 A1 6/2010 Murthy et al.
2010/0185168 A1 7/2010 Graauw et al.
2010/0198172 A1 8/2010 Wada et al.
2010/0211032 A1 8/2010 Tsai et al.
2010/0234820 A1 9/2010 Tsai et al.
2010/0241104 A1 9/2010 Gilbert
2010/0263113 A1 10/2010 Shelton et al.
2010/0310845 A1 12/2010 Bond et al.
2011/0028922 A1 2/2011 Kay et al.
2011/0034889 A1 2/2011 Smith
2011/0036837 A1 2/2011 Shang
2011/0040267 A1 2/2011 Wada et al.
2011/0040271 A1 2/2011 Rogers et al.
2011/0054426 A1 3/2011 Stewart et al.
2011/0060300 A1 3/2011 Weig et al.
2011/0077495 A1 3/2011 Gilbert
2011/0077606 A1 3/2011 Wilcox et al.
2011/0087337 A1 4/2011 Forsell
2011/0137273 A1 6/2011 Muellejans et al.
2011/0152802 A1 6/2011 Dicamillo et al.
2011/0172620 A1 7/2011 Khambatta
2011/0172625 A1 7/2011 Wada et al.
2011/0202024 A1 8/2011 Cozzens
2011/0240648 A1 10/2011 Tucker
2011/0251572 A1 10/2011 Nishtala et al.
2011/0265889 A1 11/2011 Tanaka et al.
2012/0035577 A1 2/2012 Tomes et al.
2012/0041400 A1 2/2012 Christensen
2012/0059328 A1 3/2012 Dikeman et al.
2012/0066825 A1 3/2012 Birbara et al.
2012/0103347 A1 5/2012 Wheaton et al.
2012/0137420 A1 6/2012 Gordon et al.
2012/0165768 A1 6/2012 Sekiyama et al.
2012/0165786 A1 6/2012 Chappa et al.
2012/0210503 A1 8/2012 Anzivino et al.
2012/0233761 A1 9/2012 Huang
2012/0245542 A1 9/2012 Suzuki et al.
2012/0245547 A1 9/2012 Wilcox et al.
2012/0253303 A1 10/2012 Suzuki et al.
2012/0330256 A1 12/2012 Wilcox et al.
2013/0006206 A1 1/2013 Wada et al.
2013/0045651 A1 2/2013 Esteves et al.
2013/0053804 A1 2/2013 Soerensen et al.
2013/0096523 A1 4/2013 Chang et al.
2013/0245496 A1 9/2013 Wells et al.
2013/0245586 A1 9/2013 Jha
2013/0292537 A1 11/2013 Dirico
2014/0031774 A1 1/2014 Bengtson
2014/0157499 A1 6/2014 Suzuki et al.
2014/0182051 A1 7/2014 Tanimoto et al.
2014/0196189 A1 7/2014 Lee et al.
2014/0276501 A1 9/2014 Cisko
2014/0303582 A1 10/2014 Wright et al.
2014/0316381 A1 10/2014 Reglin
2014/0325746 A1 11/2014 Block
2014/0348139 A1 11/2014 Gomez Martinez
2014/0352050 A1 12/2014 Yao et al.
2014/0371628 A1 12/2014 Desai
2015/0045757 A1 2/2015 Lee et al.
2015/0047114 A1 2/2015 Ramirez
2015/0048089 A1 2/2015 Robertson
2015/0135423 A1 5/2015 Sharpe et al.
2015/0157300 A1 6/2015 Ealovega et al.
2015/0209194 A1 7/2015 Heyman
2015/0290425 A1 10/2015 Macy et al.
2015/0320583 A1 11/2015 Harvie
2015/0329255 A1 11/2015 Rzepecki
2015/0359660 A1 12/2015 Harvie
2015/0366699 A1 12/2015 Nelson
2016/0029998 A1 2/2016 Brister et al.
2016/0030228 A1 2/2016 Jones
2016/0038356 A1 2/2016 Yao et al.
2016/0058322 A1 3/2016 Brister et al.
2016/0060001 A1 3/2016 Wada et al.
2016/0100976 A1 4/2016 Conway et al.
2016/0106604 A1 4/2016 Timm
2016/0113809 A1 4/2016 Kim
2016/0183689 A1 6/2016 Miner
2016/0256022 A1 9/2016 Le
2016/0270982 A1 9/2016 Raycheck et al.
2016/0278662 A1 9/2016 Brister et al.
2016/0366699 A1 12/2016 Zhang et al.
2016/0367226 A1 12/2016 Newton et al.
2016/0367411 A1 12/2016 Justiz et al.
2016/0367726 A1 12/2016 Gratzer
2016/0374848 A1 12/2016 Sanchez et al.
2017/0007438 A1 1/2017 Harvie
2017/0128638 A1 5/2017 Giezendanner et al.
2017/0143534 A1 5/2017 Sanchez
2017/0165405 A1 6/2017 Muser et al.
2017/0189225 A1 7/2017 Voorhees et al.
2017/0202692 A1 7/2017 Laniado
2017/0216081 A1 8/2017 Accosta
2017/0246026 A1 8/2017 Laniado
2017/0252014 A1 9/2017 Siller Gonzalez et al.
2017/0252202 A9 9/2017 Sanchez et al.
2017/0266031 A1 9/2017 Sanchez et al.
2017/0266658 A1 9/2017 Bruno et al.
2017/0281399 A1 10/2017 Vanmiddendorp et al.
2017/0312116 A1 11/2017 Laniado
2017/0325788 A1 11/2017 Ealovega et al.
2017/0333244 A1 11/2017 Laniado
2017/0042748 A1 12/2017 Griffin
2017/0348139 A1 12/2017 Newton et al.
2017/0354532 A1 12/2017 Holt
2017/0367873 A1 12/2017 Grannum
2018/0002075 A1 1/2018 Lee
2018/0008451 A1 1/2018 Stroebech
2018/0008804 A1 1/2018 Laniado
2018/0028349 A1 2/2018 Newton et al.
2018/0037384 A1 2/2018 Archeny et al.
2018/0049910 A1 2/2018 Newton
2018/0064572 A1 3/2018 Wiltshire
2018/0104131 A1* 4/2018 Killian ..... A61H 3/00
2018/0127187 A1 5/2018 Sewell

(56) References Cited

U.S. PATENT DOCUMENTS

| | | | |
|---|---|---|---|
| 2018/0193215 | A1 | 7/2018 | Davies et al. |
| 2018/0200101 | A1 | 7/2018 | Su |
| 2018/0228642 | A1 | 8/2018 | Davis et al. |
| 2018/0256384 | A1 | 9/2018 | Kasirye |
| 2018/0271694 | A1 | 9/2018 | Fernandez et al. |
| 2019/0001030 | A1 | 1/2019 | Braga et al. |
| 2019/0021899 | A1 | 1/2019 | Vlet |
| 2019/0038451 | A1 | 2/2019 | Harvie |
| 2019/0046102 | A1 | 2/2019 | Kushnir et al. |
| 2019/0100362 | A1 | 4/2019 | Meyers et al. |
| 2019/0133814 | A1 | 5/2019 | Tammen et al. |
| 2019/0142624 | A1 | 5/2019 | Sanchez et al. |
| 2019/0224036 | A1 | 7/2019 | Sanchez et al. |
| 2019/0247222 | A1 | 8/2019 | Ecklund et al. |
| 2019/0282391 | A1 | 9/2019 | Johannes et al. |
| 2019/0314189 | A1 | 10/2019 | Acosta |
| 2019/0314190 | A1 | 10/2019 | Sanchez et al. |
| 2019/0344934 | A1 | 11/2019 | Faerber et al. |
| 2019/0365307 | A1 | 12/2019 | Laing et al. |
| 2019/0365561 | A1 | 12/2019 | Newton et al. |
| 2020/0046544 | A1 | 2/2020 | Godinez et al. |
| 2020/0055638 | A1 | 2/2020 | Lau et al. |
| 2020/0070392 | A1 | 3/2020 | Huber et al. |
| 2020/0085610 | A1 | 3/2020 | Cohn et al. |
| 2020/0086090 | A1 | 3/2020 | Von Weymarn-Schärli et al. |
| 2020/0171217 | A9 | 6/2020 | Braga et al. |
| 2020/0229964 | A1 | 7/2020 | Staali et al. |
| 2020/0231343 | A1 | 7/2020 | Freedman et al. |
| 2020/0232841 | A1 | 7/2020 | Satish et al. |
| 2020/0255189 | A1 | 8/2020 | Liu |
| 2020/0261280 | A1 | 8/2020 | Heyman |
| 2020/0276046 | A1 | 9/2020 | Staali et al. |
| 2020/0306075 | A1 | 10/2020 | Newton et al. |
| 2020/0331672 | A1 | 10/2020 | Bertram et al. |
| 2020/0345332 | A1 | 11/2020 | Duval |
| 2020/0353135 | A1 | 11/2020 | Gregory et al. |
| 2020/0367677 | A1 | 11/2020 | Silsby et al. |
| 2020/0369444 | A1 | 11/2020 | Silsby et al. |
| 2020/0385179 | A1 | 12/2020 | Mccourt |
| 2020/0390591 | A1 | 12/2020 | Glithero et al. |
| 2020/0390592 | A1 | 12/2020 | Merrill |
| 2020/0405521 | A1 | 12/2020 | Glasroe |
| 2021/0008771 | A1 | 1/2021 | Huber et al. |
| 2021/0009323 | A1 | 1/2021 | Markarian et al. |
| 2021/0061523 | A1 | 3/2021 | Bytheway |
| 2021/0069005 | A1 | 3/2021 | Sanchez et al. |
| 2021/0069008 | A1 | 3/2021 | Blabas et al. |
| 2021/0113749 | A1 | 4/2021 | Radl et al. |
| 2021/0121318 | A1 | 4/2021 | Pinlac |
| 2021/0137724 | A1 | 5/2021 | Ecklund et al. |
| 2021/0154055 | A1 | 5/2021 | Villarreal |
| 2021/0170079 | A1 | 6/2021 | Radl et al. |
| 2021/0220162 | A1 | 7/2021 | Jamison |
| 2021/0220163 | A1 | 7/2021 | Mayrand |
| 2021/0228400 | A1 | 7/2021 | Glithero |
| 2021/0228795 | A1 | 7/2021 | Hughett et al. |
| 2021/0229877 | A1 | 7/2021 | Ragias et al. |
| 2021/0267787 | A1 | 9/2021 | Nazemi |
| 2021/0386925 | A1 | 12/2021 | Hartwell et al. |
| 2021/0393433 | A1 | 12/2021 | Godinez et al. |
| 2022/0023091 | A1 | 1/2022 | Ecklund et al. |
| 2022/0062027 | A1 | 3/2022 | Mitchell et al. |
| 2022/0066825 | A1 | 3/2022 | Saraf et al. |
| 2022/0071811 | A1 | 3/2022 | Cheng et al. |
| 2022/0104965 | A1 | 4/2022 | Vaninetti et al. |
| 2022/0117774 | A1 | 4/2022 | Meyer et al. |
| 2022/0117775 | A1 | 4/2022 | Jones et al. |
| 2022/0151817 | A1 | 5/2022 | Mann |
| 2022/0248836 | A1 | 8/2022 | Cagle et al. |
| 2022/0354685 | A1 | 11/2022 | Davis et al. |
| 2023/0062944 | A1 | 3/2023 | Vollenberg et al. |
| 2023/0062994 | A1 | 3/2023 | Ecklund et al. |

FOREIGN PATENT DOCUMENTS

| | | | |
|---|---|---|---|
| CA | 2354132 | A1 | 6/2000 |
| CA | 2488867 | C | 8/2007 |
| CA | 3050918 | A1 | 8/2018 |
| CA | 3098571 | A1 | 11/2019 |
| CN | 2269203 | Y | 12/1997 |
| CN | 1332620 | A | 1/2002 |
| CN | 1533755 | A | 10/2004 |
| CN | 1602825 | A | 4/2005 |
| CN | 1720888 | A | 1/2006 |
| CN | 2936204 | Y | 8/2007 |
| CN | 101262836 | A | 9/2008 |
| CN | 102159159 | A | 8/2011 |
| CN | 202184840 | U | 4/2012 |
| CN | 102481441 | A | 5/2012 |
| CN | 103717180 | A | 4/2014 |
| CN | 204562697 | U | 8/2015 |
| CN | 105451693 | A | 3/2016 |
| CN | 205849719 | U | 1/2017 |
| CN | 107847384 | A | 3/2018 |
| CN | 107920912 | A | 4/2018 |
| CN | 209285902 | U | 8/2019 |
| CN | 211198839 | U | 8/2020 |
| DE | 79818 | C | 10/1893 |
| DE | 1516466 | A1 | 6/1969 |
| DE | 2721330 | A1 | 11/1977 |
| DE | 2742298 | A1 | 3/1978 |
| DE | 9407554.9 | U1 | 5/1995 |
| DE | 4443710 | A1 | 6/1995 |
| DE | 19619597 | A1 | 11/1997 |
| DE | 102011103783 | A1 | 12/2012 |
| DE | 202015104597 | U1 | 7/2016 |
| DK | 9600118 | | 11/1996 |
| EP | 0032138 | A2 | 7/1981 |
| EP | 0066070 | B1 | 12/1982 |
| EP | 0119143 | B1 | 11/1988 |
| EP | 0610638 | A1 | 8/1994 |
| EP | 0613355 | A1 | 9/1994 |
| EP | 0613355 | B1 | 1/1997 |
| EP | 0966936 | A1 | 12/1999 |
| EP | 0987293 | A1 | 3/2000 |
| EP | 0653928 | B1 | 10/2002 |
| EP | 1332738 | A1 | 8/2003 |
| EP | 1382318 | A1 | 1/2004 |
| EP | 1089684 | B1 | 10/2004 |
| EP | 1616542 | A1 | 1/2006 |
| EP | 1382318 | B1 | 5/2006 |
| EP | 1063953 | B1 | 1/2007 |
| EP | 1872752 | A1 | 1/2008 |
| EP | 2180907 | A1 | 5/2010 |
| EP | 2380532 | A1 | 10/2011 |
| EP | 2389908 | A1 | 11/2011 |
| EP | 2601916 | A1 | 6/2013 |
| EP | 2676643 | A1 | 12/2013 |
| EP | 2997950 | A2 | 3/2016 |
| EP | 2879534 | B1 | 3/2017 |
| EP | 3424471 | A1 | 1/2019 |
| EP | 3169292 | B1 | 11/2019 |
| EP | 3788992 | A1 | 3/2021 |
| EP | 3576689 | B1 | 3/2022 |
| EP | 3752110 | B1 | 3/2022 |
| EP | 4025163 | A1 | 7/2022 |
| GB | 1011517 | A | 12/1965 |
| GB | 1467144 | A | 3/1977 |
| GB | 2106395 | A | 4/1983 |
| GB | 2106784 | A | 4/1983 |
| GB | 2148126 | A | 5/1985 |
| GB | 2171315 | A | 8/1986 |
| GB | 2148126 | B | 7/1987 |
| GB | 2191095 | A | 12/1987 |
| GB | 2199750 | A | 7/1988 |
| GB | 2260907 | A | 5/1993 |
| GB | 2462267 | A | 2/2010 |
| GB | 2469496 | A | 10/2010 |
| GB | 2490327 | A | 10/2012 |
| GB | 2507318 | A | 4/2014 |
| IT | 201800009129 | A1 | 4/2020 |
| JP | S5410596 | A | 1/1979 |

(56) References Cited

FOREIGN PATENT DOCUMENTS

| | | | |
|---|---|---|---|
| JP | S5410596 | Y2 | 5/1979 |
| JP | S55155618 | A | 12/1980 |
| JP | S5888596 | U | 6/1983 |
| JP | S63107780 | U | 7/1988 |
| JP | H0267530 | A | 3/1990 |
| JP | H02103871 | A | 4/1990 |
| JP | H02131422 | A | 5/1990 |
| JP | H0460220 | A | 2/1992 |
| JP | H05123349 | A | 5/1993 |
| JP | 3087938 | B2 | 10/1995 |
| JP | H1040141 | A | 2/1998 |
| JP | H11113946 | A | 4/1999 |
| JP | H11290365 | A | 10/1999 |
| JP | 2000185068 | A | 7/2000 |
| JP | 2001054531 | A | 2/2001 |
| JP | 2001070331 | | 3/2001 |
| JP | 2001276107 | A | 10/2001 |
| JP | 2001276108 | A | 10/2001 |
| JP | 2002028173 | A | 1/2002 |
| JP | 2003180722 | A | 7/2003 |
| JP | 2004130056 | A | 4/2004 |
| JP | 2004267530 | A | 9/2004 |
| JP | 2005066011 | A | 3/2005 |
| JP | 2005066325 | A | 3/2005 |
| JP | 2005518237 | A | 6/2005 |
| JP | 3749097 | B2 | 12/2005 |
| JP | 2006026108 | A | 2/2006 |
| JP | 3123547 | B2 | 6/2006 |
| JP | 2006136492 | A | 6/2006 |
| JP | 2006204868 | A | 8/2006 |
| JP | 3132659 | B2 | 5/2007 |
| JP | 4039641 | B2 | 11/2007 |
| JP | 2009509570 | A | 3/2009 |
| JP | 2010081981 | A | 4/2010 |
| JP | 4640772 | B2 | 12/2010 |
| JP | 2010536439 | A | 12/2010 |
| JP | 4747166 | B2 | 5/2011 |
| JP | 2011087823 | A | 5/2011 |
| JP | 4801218 | B1 | 8/2011 |
| JP | 2011218130 | A | 11/2011 |
| JP | 2011224070 | A | 11/2011 |
| JP | 2012523869 | A | 10/2012 |
| JP | 2015092945 | A | 5/2015 |
| JP | 3198994 | B2 | 7/2015 |
| JP | 2019525811 | A | 9/2019 |
| JP | 2021120686 | A | 8/2021 |
| KR | 200290061 | Y1 | 9/2002 |
| KR | 20030047451 | A | 6/2003 |
| KR | 20140039485 | A | 4/2014 |
| KR | 101432639 | B1 | 8/2014 |
| KR | 20180106659 | A | 10/2018 |
| KR | 20180108774 | A | 10/2018 |
| PT | 2068717 | E | 6/2013 |
| WO | 8101957 | A1 | 7/1981 |
| WO | 8804558 | A1 | 6/1988 |
| WO | 9104714 | A2 | 4/1991 |
| WO | 9104714 | A3 | 6/1991 |
| WO | 9220299 | A3 | 2/1993 |
| WO | 9309736 | A2 | 5/1993 |
| WO | 9309736 | A3 | 6/1993 |
| WO | 9514448 | A2 | 6/1995 |
| WO | 9600096 | A1 | 1/1996 |
| WO | 9634636 | A1 | 11/1996 |
| WO | 9817211 | A1 | 4/1998 |
| WO | 9830336 | A1 | 7/1998 |
| WO | 0000112 | A1 | 1/2000 |
| WO | 0000113 | A1 | 1/2000 |
| WO | 0025651 | A1 | 5/2000 |
| WO | 0033773 | A1 | 6/2000 |
| WO | 0057784 | A1 | 10/2000 |
| WO | 0145618 | A1 | 6/2001 |
| WO | 0145621 | A1 | 6/2001 |
| WO | 02094160 | A1 | 11/2002 |
| WO | 03013967 | A1 | 2/2003 |
| WO | 03024824 | A1 | 3/2003 |
| WO | 03055423 | A1 | 7/2003 |
| WO | 03071931 | A2 | 9/2003 |
| WO | 03079942 | A1 | 10/2003 |
| WO | 03071931 | A3 | 2/2004 |
| WO | 2004019836 | A1 | 3/2004 |
| WO | 2004024046 | A1 | 3/2004 |
| WO | 2005074571 | A3 | 9/2005 |
| WO | 2005089687 | A2 | 9/2005 |
| WO | 2005107661 | A2 | 11/2005 |
| WO | 2006021220 | A1 | 3/2006 |
| WO | 2007007845 | A1 | 1/2007 |
| WO | 2007042823 | A2 | 4/2007 |
| WO | 2007055651 | A1 | 5/2007 |
| WO | 2006098950 | A3 | 11/2007 |
| WO | 2007134608 | A2 | 11/2007 |
| WO | 2007128156 | A3 | 2/2008 |
| WO | 2008078117 | A1 | 7/2008 |
| WO | 2008104019 | A1 | 9/2008 |
| WO | 2008141471 | A1 | 11/2008 |
| WO | 2009004368 | A1 | 1/2009 |
| WO | 2009004369 | A1 | 1/2009 |
| WO | 2009052496 | A1 | 4/2009 |
| WO | 2009007702 | A4 | 7/2009 |
| WO | 2009101738 | A1 | 8/2009 |
| WO | 2010058192 | A1 | 5/2010 |
| WO | 2010030122 | A3 | 7/2010 |
| WO | 2010101915 | A3 | 1/2011 |
| WO | 2011018132 | A1 | 2/2011 |
| WO | 2011018133 | A1 | 2/2011 |
| WO | 2011024864 | A1 | 3/2011 |
| WO | 2011054118 | A1 | 5/2011 |
| WO | 2011079132 | A1 | 6/2011 |
| WO | 2011107972 | A1 | 9/2011 |
| WO | 2011108972 | A1 | 9/2011 |
| WO | 2011117292 | A1 | 9/2011 |
| WO | 2011123219 | A1 | 10/2011 |
| WO | 2011132043 | A1 | 10/2011 |
| WO | 2012012908 | A1 | 2/2012 |
| WO | 2012065274 | A1 | 5/2012 |
| WO | 2012097462 | A1 | 7/2012 |
| WO | 2012098796 | A1 | 7/2012 |
| WO | 2012101288 | A1 | 8/2012 |
| WO | 2012175916 | A1 | 12/2012 |
| WO | 2013018435 | A1 | 2/2013 |
| WO | 2013033429 | A1 | 3/2013 |
| WO | 2013055434 | A1 | 4/2013 |
| WO | 2013103291 | A2 | 7/2013 |
| WO | 2013131109 | A1 | 9/2013 |
| WO | 2013167478 | A1 | 11/2013 |
| WO | 2013177716 | A1 | 12/2013 |
| WO | 2014041534 | A1 | 3/2014 |
| WO | 2014046420 | A1 | 3/2014 |
| WO | 2014118518 | A1 | 8/2014 |
| WO | 2014160852 | A1 | 10/2014 |
| WO | 2015023599 | A1 | 2/2015 |
| WO | 2015052348 | A1 | 4/2015 |
| WO | 2015068384 | A1 | 5/2015 |
| WO | 2015169403 | A1 | 11/2015 |
| WO | 2015170307 | A1 | 11/2015 |
| WO | 2015197462 | A1 | 12/2015 |
| WO | 2016051385 | A1 | 4/2016 |
| WO | 2016055989 | A1 | 4/2016 |
| WO | 2016071894 | A1 | 5/2016 |
| WO | 2016103242 | A1 | 6/2016 |
| WO | 2016116915 | A1 | 7/2016 |
| WO | 2016124203 | A1 | 8/2016 |
| WO | 2016139448 | A1 | 9/2016 |
| WO | 2016166562 | A1 | 10/2016 |
| WO | 2016167535 | A1 | 10/2016 |
| WO | 2016191574 | A1 | 12/2016 |
| WO | 2016200088 | A1 | 12/2016 |
| WO | 2016200361 | A1 | 12/2016 |
| WO | 2016204731 | A1 | 12/2016 |
| WO | 2017001846 | A1 | 1/2017 |
| WO | 2017152198 | A1 | 9/2017 |
| WO | 2017162559 | A1 | 9/2017 |
| WO | 2017205446 | A1 | 11/2017 |
| WO | 2017209779 | A1 | 12/2017 |
| WO | 2017210524 | A1 | 12/2017 |

(56) References Cited

FOREIGN PATENT DOCUMENTS

| | | | |
|---|---|---|---|
| WO | 2018022414 | A1 | 2/2018 |
| WO | 2018044781 | A1 | 3/2018 |
| WO | 2018056953 | A1 | 3/2018 |
| WO | 2018090550 | A1 | 5/2018 |
| WO | 2018138513 | A1 | 8/2018 |
| WO | 2018144318 | A1 | 8/2018 |
| WO | 2018144463 | A1 | 8/2018 |
| WO | 2018150263 | A1 | 8/2018 |
| WO | 2018150268 | A1 | 8/2018 |
| WO | 2018152156 | A1 | 8/2018 |
| WO | 2018183791 | A1 | 10/2018 |
| WO | 2018150267 | A3 | 11/2018 |
| WO | 2018235026 | A1 | 12/2018 |
| WO | 2018235065 | A1 | 12/2018 |
| WO | 2019004404 | A1 | 1/2019 |
| WO | 2019065541 | A1 | 4/2019 |
| WO | 2019096845 | A1 | 5/2019 |
| WO | 2019150385 | A1 | 8/2019 |
| WO | 2019161094 | A1 | 8/2019 |
| WO | 2019188566 | A1 | 10/2019 |
| WO | 2019190593 | A1 | 10/2019 |
| WO | 2019212949 | A1 | 11/2019 |
| WO | 2019212950 | A1 | 11/2019 |
| WO | 2019212951 | A1 | 11/2019 |
| WO | 2019212952 | A1 | 11/2019 |
| WO | 2019212954 | A1 | 11/2019 |
| WO | 2019212955 | A1 | 11/2019 |
| WO | 2019212956 | A1 | 11/2019 |
| WO | 2019214787 | A1 | 11/2019 |
| WO | 2019214788 | A1 | 11/2019 |
| WO | 2020000994 | A1 | 1/2020 |
| WO | 2020020618 | A1 | 1/2020 |
| WO | 2020038822 | A1 | 2/2020 |
| WO | 2020088409 | A1 | 5/2020 |
| WO | 2020049394 | A3 | 6/2020 |
| WO | 2020120657 | A1 | 6/2020 |
| WO | 2020152575 | A1 | 7/2020 |
| WO | 2020182923 | A1 | 9/2020 |
| WO | 2020204967 | A1 | 10/2020 |
| WO | 2020209898 | A1 | 10/2020 |
| WO | 2020242790 | A1 | 12/2020 |
| WO | 2020251893 | A1 | 12/2020 |
| WO | 2020256865 | A1 | 12/2020 |
| WO | 2021007144 | A1 | 1/2021 |
| WO | 2021007345 | A1 | 1/2021 |
| WO | 2021010844 | A1 | 1/2021 |
| WO | 2021016026 | A1 | 1/2021 |
| WO | 2021016300 | A1 | 1/2021 |
| WO | 2021025919 | A1 | 2/2021 |
| WO | 2021034886 | A1 | 2/2021 |
| WO | 2021041123 | A1 | 3/2021 |
| WO | 2021094352 | A1 | 5/2021 |
| WO | 2021102296 | A1 | 5/2021 |
| WO | 2021138411 | A1 | 7/2021 |
| WO | 2021138414 | A1 | 7/2021 |
| WO | 2021155206 | A1 | 8/2021 |
| WO | 2021173436 | A1 | 9/2021 |
| WO | 2021195384 | A1 | 9/2021 |
| WO | 2021207621 | A1 | 10/2021 |
| WO | 2021211568 | A1 | 10/2021 |
| WO | 2021216419 | A1 | 10/2021 |
| WO | 2021257202 | A1 | 12/2021 |
| WO | 2022006256 | A1 | 1/2022 |
| WO | 2022031943 | A1 | 2/2022 |
| WO | 2022035745 | A1 | 2/2022 |
| WO | 2022076427 | A2 | 4/2022 |
| WO | 2022086898 | A1 | 4/2022 |
| WO | 2022140545 | A1 | 6/2022 |
| WO | 2022150360 | A1 | 7/2022 |
| WO | 2022150463 | A1 | 7/2022 |
| WO | 2022159392 | A1 | 7/2022 |
| WO | 2022170182 | A1 | 8/2022 |
| WO | 2022182385 | A1 | 9/2022 |
| WO | 2022192188 | A1 | 9/2022 |
| WO | 2022192347 | A1 | 9/2022 |

OTHER PUBLICATIONS

Advisory Action for U.S. Appl. No. 14/722,613 dated Mar. 4, 2019.
Advisory Action for U.S. Appl. No. 14/952,591 dated Jun. 1, 2018.
Advisory Action for U.S. Appl. No. 15/238,427 dated Apr. 10, 2019.
Advisory Action for U.S. Appl. No. 16/899,956 dated Jul. 9, 2021.
Advisory Action for U.S. Appl. No. 16/904,868 dated Jul. 2, 2021.
Advisory Action for U.S. Appl. No. 16/905,400 dated Jun. 9, 2021.
Corrected International Search Report and Written Opinion for International Application No. PCT/US2017/043025 dated Jan. 11, 2018.
Corrected Notice of Allowability for U.S. Appl. No. 15/221,106 dated Jul. 2, 2019.
Corrected Notice of Allowability for U.S. Appl. No. 15/612,325 dated Mar. 17, 2021.
Final Office Action for U.S. Appl. No. 14/722,613 dated Nov. 29, 2018.
Final Office Action for U.S. Appl. No. 14/947,759 dated Apr. 8, 2016.
Final Office Action for U.S. Appl. No. 14/952,591 dated Feb. 23, 2018.
Final Office Action for U.S. Appl. No. 14/952,591 dated Nov. 1, 2019.
Final Office Action for U.S. Appl. No. 14/952,591 dated Nov. 27, 2020.
Final Office Action for U.S. Appl. No. 15/171,968 dated Feb. 14, 2020.
Final Office Action for U.S. Appl. No. 15/171,968 dated Mar. 19, 2019.
Final Office Action for U.S. Appl. No. 15/221,106 dated Jan. 23, 2019.
Final Office Action for U.S. Appl. No. 15/238,427 dated Jan. 2, 2019.
Final Office Action for U.S. Appl. No. 15/260,103 dated Feb. 14, 2019.
Final Office Action for U.S. Appl. No. 15/612,325 dated Sep. 17, 2020.
Final Office Action for U.S. Appl. No. 16/899,956 dated Apr. 19, 2021.
Final Office Action for U.S. Appl. No. 16/904,868 dated Mar. 26, 2021.
Final Office Action for U.S. Appl. No. 16/905,400 dated Apr. 6, 2021.
Final Office Action for U.S. Appl. No. 17/088,272 dated May 25, 2021.
Final Office Action for U.S. Appl. No. 29/624,661 dated Feb. 18, 2020.
International Search Report and Written Opinion from International Application No. PCT/US2016/049274 dated Dec. 1, 2016.
International Search Report and Written Opinion from International Application No. PCT/US2017/035625 dated Aug. 15, 2017.
International Search Report and Written Opinion from International Application No. PCT/US2017/043025 dated Oct. 18, 2017.
International Search Report and Written Opinion from International Application No. PCT/US2018/015968 dated Apr. 6, 2018.
International Search Report and Written Opinion from International Application No. PCT/US2019/029608 dated Sep. 3, 2019.
International Search Report and Written Opinion from International Application No. PCT/US2019/029609 dated Sep. 3, 2019.
International Search Report and Written Opinion from International Application No. PCT/US2019/029610 dated Sep. 3, 2019.
International Search Report and Written Opinion from International Application No. PCT/US2019/029611 dated Jul. 3, 2019.
International Search Report and Written Opinion from International Application No. PCT/US2019/029613 dated Jul. 3, 2019.
International Search Report and Written Opinion from International Application No. PCT/US2019/029614 dated Sep. 26, 2019.
International Search Report and Written Opinion from International Application No. PCT/US2019/029616 dated Aug. 30, 2019.
International Search Report and Written Opinion from International Application No. PCT/US2020/023572 dated Jul. 6, 2020.
International Search Report and Written Opinion from International Application No. PCT/US2020/033064 dated Aug. 31, 2020.

(56) References Cited

OTHER PUBLICATIONS

International Search Report and Written Opinion from International Application No. PCT/US2020/033122 dated Aug. 31, 2020.
International Search Report and Written Opinion from International Application No. PCT/US2020/040860 dated Oct. 2, 2020.
International Search Report and Written Opinion from International Application No. PCT/US2020/041242 dated Nov. 17, 2020.
International Search Report and Written Opinion from International Application No. PCT/US2020/041249 dated Oct. 2, 2020.
International Search Report and Written Opinion from International Application No. PCT/US2020/042262 dated Oct. 14, 2020.
International Search Report and Written Opinion from International Application No. PCT/US2020/043059 dated Oct. 6, 2020.
International Search Report and Written Opinion from International Application No. PCT/US2020/044024 dated Nov. 12, 2020.
International Search Report and Written Opinion from International Application No. PCT/US2020/046914 dated Dec. 1, 2020.
International Search Report and Written Opinion from International Application No. PCT/US2020/055680 dated Dec. 15, 2020.
International Search Report and Written Opinion from International Application No. PCT/US2020/061563 dated Feb. 19, 2021.
International Search Report and Written Opinion from International Application No. PCT/US2020/065234 dated Apr. 12, 2021.
International Search Report and Written Opinion from International Application No. PCT/US2020/067451 dated Mar. 25, 2021.
International Search Report and Written Opinion from International Application No. PCT/US2020/067454 dated Mar. 29, 2021.
International Search Report and Written Opinion from International Application No. PCT/US2020/067455 dated Mar. 26, 2021.
International Search Report and Written Opinion from International Application No. PCT/US2021/015787 dated May 27, 2021.
International Search Report and Written Opinion from International Application No. PCT/US2021/023001 dated Jun. 21, 2021.
International Search Report and Written Opinion from International Application No. PCT/US2021/027061 dated Jul. 19, 2021.
International Search Report and Written Opinion from International Application No. PCT/US2021/027104 dated Jul. 6, 2021.
International Search Report and Written Opinion from International Application No. PCT/US2021/027314 dated Jul. 6, 2021.
International Search Report and Written Opinion from International Application No. PCT/US2021/027913 dated Jul. 12, 2021.
Issue Notification for U.S. Appl. No. 14/952,591 dated Jul. 28, 2021.
Issue Notification for U.S. Appl. No. 15/171,968 dated Mar. 3, 2021.
Issue Notification for U.S. Appl. No. 15/221,106 dated Jul. 24, 2019.
Issue Notification for U.S. Appl. No. 15/238,427 dated Jul. 24, 2019.
Issue Notification for U.S. Appl. No. 15/260,103 dated Aug. 7, 2019.
Issue Notification for U.S. Appl. No. 15/611,587 dated Feb. 20, 2019.
Issue Notification for U.S. Appl. No. 15/612,325 dated Mar. 24, 2021.
Issue Notification for U.S. Appl. No. 29/624,661 dated Aug. 4, 2021.
Non-Final Office Action for U.S. Appl. No. 14/592,591 dated Mar. 20, 2020.
Non-Final Office Action for U.S. Appl. No. 14/722,613 dated Jun. 13, 2019.
Non-Final Office Action for U.S. Appl. No. 14/947,759 dated Mar. 17, 2016.
Non-Final Office Action for U.S. Appl. No. 14/952,591 dated Aug. 1, 2017.
Non-Final Office Action for U.S. Appl. No. 14/952,591 dated Mar. 20, 2020.
Non-Final Office Action for U.S. Appl. No. 14/952,591 dated Mar. 21, 2019.
Non-Final Office Action for U.S. Appl. No. 14/952,591 dated Sep. 28, 2018.
Non-Final Office Action for U.S. Appl. No. 15/171,968 dated May 11, 2020.
Non-Final Office Action for U.S. Appl. No. 15/171,968 dated Aug. 20, 2019.
Non-Final Office Action for U.S. Appl. No. 15/171,968 dated Jun. 12, 2018.
Non-Final Office Action for U.S. Appl. No. 15/221,106 dated Jun. 5, 2018.
Non-Final Office Action for U.S. Appl. No. 15/238,427 dated Aug. 8, 2018.
Non-Final Office Action for U.S. Appl. No. 15/260,103 dated Sep. 26, 2018.
Non-Final Office Action for U.S. Appl. No. 15/611,587 dated Dec. 29, 2017.
Non-Final Office Action for U.S. Appl. No. 15/611,587 dated Jul. 13, 2018.
Non-Final Office Action for U.S. Appl. No. 15/612,325 dated Mar. 19, 2020.
Non-Final Office Action for U.S. Appl. No. 16/899,956 dated Oct. 16, 2020.
Non-Final Office Action for U.S. Appl. No. 16/904,868 dated Nov. 25, 2020.
Non-Final Office Action for U.S. Appl. No. 16/905,400 dated Dec. 2, 2020.
Non-Final Office Action for U.S. Appl. No. 16/905,400 dated Jul. 22, 2021.
Non-Final Office Action for U.S. Appl. No. 17/088,272 dated Jan. 25, 2021.
Non-Final Office Action for U.S. Appl. No. 29/624,661 dated Jul. 18, 2019.
Non-Final Office Action for U.S. Appl. No. 29/694,002 dated Jun. 24, 2020.
Notice of Allowance for U.S. Appl. No. 14/952,591 dated Apr. 5, 2021.
Notice of Allowance for U.S. Appl. No. 14/952,591 dated Jul. 8, 2021.
Notice of Allowance for U.S. Appl. No. 15/171,968 dated Feb. 16, 2021.
Notice of Allowance for U.S. Appl. No. 15/171,968 dated Nov. 6, 2020.
Notice of Allowance for U.S. Appl. No. 15/221,106 dated May 1, 2019.
Notice of Allowance for U.S. Appl. No. 15/238,427 dated May 23, 2019.
Notice of Allowance for U.S. Appl. No. 15/260,103 dated Jun. 7, 2019.
Notice of Allowance for U.S. Appl. No. 15/611,587 dated Dec. 21, 2018.
Notice of Allowance for U.S. Appl. No. 15/612,325 dated Feb. 19, 2021.
Notice of Allowance for U.S. Appl. No. 15/612,325 dated Jan. 21, 2021.
Notice of Allowance for U.S. Appl. No. 17/088,272 dated Aug. 5, 2021.
Notice of Allowance for U.S. Appl. No. 29/624,661 dated Apr. 28, 2021.
Notice of Allowance for U.S. Appl. No. 29/624,661 dated Jul. 10, 2020.
Notice of Allowance for U.S. Appl. No. 29/624,661 dated May 14, 2020.
Notice of Allowance for U.S. Appl. No. 29/624,661 dated Sep. 29, 2020.
Notice of Allowance for U.S. Appl. No. 29/694,002 dated Apr. 29, 2021.
Notice of Allowance for U.S. Appl. No. 29/694,002 dated Jan. 29, 2021.
Notice of Allowance for U.S. Appl. No. 29/694,002 dated Oct. 16, 2020.
Notice to File Missing Parts for U.S. Appl. No. 17/179,116 dated Mar. 3, 2021.
Restriction Requirement for U.S. Appl. No. 16/478,180 dated May 25, 2021.
U.S. Appl. No. 15/171,968, filed Jun. 2, 2016.

(56) References Cited

OTHER PUBLICATIONS

U.S. Appl. No. 15/221,106, filed Jul. 27, 2016.
U.S. Appl. No. 15/260,103, filed Sep. 8, 2016.
U.S. Appl. No. 15/611,587, filed Jun. 1, 2017.
U.S. Appl. No. 15/612,325, filed Jun. 2, 2017.
U.S. Appl. No. 16/369,676, filed Mar. 29, 2019.
U.S. Appl. No. 16/433,773, filed Jun. 6, 2019.
U.S. Appl. No. 16/449,039, filed Jun. 21, 2019.
U.S. Appl. No. 16/452,145, filed Jun. 25, 2019.
U.S. Appl. No. 16/452,258, filed Jun. 25, 2019.
U.S. Appl. No. 16/478,180, filed Jul. 16, 2019.
U.S. Appl. No. 16/904,868, filed Jun. 18, 2020.
U.S. Appl. No. 16/905,400, filed Jun. 18, 2020.
U.S. Appl. No. 17/051,550, filed Oct. 29, 2020.
U.S. Appl. No. 17/051,554, filed Oct. 29, 2020.
U.S. Appl. No. 17/051,585, filed Oct. 29, 2020.
U.S. Appl. No. 17/051,600, filed Oct. 29, 2020.
U.S. Appl. No. 17/088,272, filed Nov. 3, 2020.
U.S. Appl. No. 17/179,116, filed Feb. 18, 2021.
U.S. Appl. No. 17/330,657, filed May 26, 2021.
U.S. Appl. No. 17/378,015, filed Jul. 16, 2021.
U.S. Appl. No. 17/444,825, filed Aug. 10, 2021.
U.S. Appl. No. 17/446,256, filed Aug. 27, 2021.
U.S. Appl. No. 29/741,751, filed Jul. 15, 2020.
U.S. Appl. No. 62/452,437, filed Jan. 31, 2017.
U.S. Appl. No. 62/665,297, filed May 1, 2018.
U.S. Appl. No. 62/665,302, filed May 1, 2018.
U.S. Appl. No. 62/665,317, filed May 1, 2018.
U.S. Appl. No. 62/665,321, filed May 1, 2018.
U.S. Appl. No. 62/665,331, filed May 1, 2018.
U.S. Appl. No. 62/665,335, filed May 1, 2018.
U.S. Appl. No. 62/853,279, filed May 28, 2019.
U.S. Appl. No. 62/853,889, filed May 29, 2019.
U.S. Appl. No. 62/864,656, filed Jun. 21, 2019.
U.S. Appl. No. 62/873,045, filed Jul. 11, 2019.
U.S. Appl. No. 62/873,048, filed Jul. 11, 2019.
U.S. Appl. No. 62/876,500, filed Jul. 19, 2019.
U.S. Appl. No. 62/877,558, filed Jul. 23, 2019.
U.S. Appl. No. 62/883,172, filed Aug. 6, 2019.
U.S. Appl. No. 62/889,149, filed Aug. 20, 2019.
U.S. Appl. No. 62/938,447, filed Nov. 21, 2019.
U.S. Appl. No. 62/949,187, filed Dec. 17, 2019.
U.S. Appl. No. 62/956,756, filed Jan. 3, 2020.
U.S. Appl. No. 62/956,767, filed Jan. 3, 2020.
U.S. Appl. No. 62/956,770, filed Jan. 3, 2020.
U.S. Appl. No. 62/994,912, filed Mar. 26, 2020.
U.S. Appl. No. 63/011,445, filed Apr. 17, 2020.
U.S. Appl. No. 63/011,487, filed Apr. 17, 2020.
U.S. Appl. No. 63/011,571, filed Apr. 17, 2020.
U.S. Appl. No. 63/011,657, filed Apr. 17, 2020.
U.S. Appl. No. 63/011,760, filed Apr. 17, 2020.
U.S. Appl. No. 63/012,347, filed Apr. 20, 2020.
U.S. Appl. No. 63/012,384, filed Apr. 20, 2020.
U.S. Appl. No. 63/030,685, filed May 27, 2020.
U.S. Appl. No. 63/061,241, filed Aug. 5, 2020.
U.S. Appl. No. 63/061,244, filed Aug. 5, 2020.
U.S. Appl. No. 63/061,834, filed Aug. 6, 2020.
U.S. Appl. No. 63/064,017, filed Aug. 11, 2020.
U.S. Appl. No. 63/064,126, filed Aug. 11, 2020.
U.S. Appl. No. 63/067,542, filed Aug. 19, 2020.
U.S. Appl. No. 63/071,438, filed Aug. 28, 2020.
U.S. Appl. No. 63/073,545, filed Sep. 2, 2020.
U.S. Appl. No. 63/074,051, filed Sep. 3, 2020.
U.S. Appl. No. 63/074,066, filed Sep. 3, 2020.
U.S. Appl. No. 63/076,032, filed Sep. 9, 2020.
U.S. Appl. No. 63/076,474, filed Sep. 10, 2020.
U.S. Appl. No. 63/076,477, filed Sep. 10, 2020.
U.S. Appl. No. 63/082,261, filed Sep. 23, 2020.
U.S. Appl. No. 63/088,506, filed Oct. 7, 2020.
U.S. Appl. No. 63/088,511, filed Oct. 7, 2020.
U.S. Appl. No. 63/094,464, filed Oct. 21, 2020.
U.S. Appl. No. 63/094,498, filed Oct. 21, 2020.
U.S. Appl. No. 63/094,594, filed Oct. 21, 2020.
U.S. Appl. No. 63/094,608, filed Oct. 21, 2020.
U.S. Appl. No. 63/094,626, filed Oct. 21, 2020.
U.S. Appl. No. 63/109,066, filed Nov. 3, 2020.
U.S. Appl. No. 63/112,417, filed Nov. 11, 2020.
U.S. Appl. No. 63/119,161, filed Nov. 30, 2020.
U.S. Appl. No. 63/124,271, filed Dec. 11, 2020.
U.S. Appl. No. 63/134,287, filed Jan. 6, 2021.
U.S. Appl. No. 63/134,450, filed Jan. 6, 2021.
U.S. Appl. No. 63/134,631, filed Jan. 7, 2021.
U.S. Appl. No. 63/134,632, filed Jan. 7, 2021.
U.S. Appl. No. 63/134,754, filed Jan. 7, 2021.
U.S. Appl. No. 63/146,946, filed Feb. 8, 2021.
U.S. Appl. No. 63/147,013, filed Feb. 8, 2021.
U.S. Appl. No. 63/147,299, filed Feb. 9, 2021.
U.S. Appl. No. 63/148,723, filed Feb. 12, 2021.
U.S. Appl. No. 63/154,248, filed Feb. 26, 2021.
U.S. Appl. No. 63/155,395, filed Mar. 2, 2021.
U.S. Appl. No. 63/157,007, filed Mar. 5, 2021.
U.S. Appl. No. 63/157,014, filed Mar. 5, 2021.
U.S. Appl. No. 63/159,142, filed Mar. 10, 2021.
U.S. Appl. No. 63/159,210, filed Mar. 10, 2021.
U.S. Appl. No. 63/165,273, filed Mar. 24, 2021.
U.S. Appl. No. 63/165,384, filed Mar. 24, 2021.
U.S. Appl. No. 63/171,165, filed Apr. 6, 2021.
U.S. Appl. No. 63/172,975, filed Apr. 9, 2021.
U.S. Appl. No. 63/181,695, filed Apr. 29, 2021.
U.S. Appl. No. 63/192,274, filed May 24, 2021.
U.S. Appl. No. 63/193,235, filed May 26, 2021.
U.S. Appl. No. 63/193,406, filed May 26, 2021.
U.S. Appl. No. 63/214,551, filed Jun. 24, 2021.
U.S. Appl. No. 63/214,570, filed Jun. 24, 2021.
U.S. Appl. No. 63/228,252, filed Aug. 2, 2021.
U.S. Appl. No. 63/228,258, filed Aug. 2, 2021.
U.S. Appl. No. 63/230,894, filed Aug. 9, 2021.
Defendant and Counterclaim Plaintiff Sage Products, LLC'S Answer, Defenses, and Counterclaims to Plaintiff's Amended Complaint, Nov. 1, 2019.
Memorandum Order, Feb. 2021, 14 pgs.
Sage's Initial Invalidity Contentions Regarding U.S. Pat. Nos. 8,287,508 10,226,375; and 10,390,989, May 29, 2020, 193 pages.
Sage's Supplemental and Initial Invalidity Contentions Regarding U.S. Pat. Nos. 8,287,508; 10,226,375; 10,390,989 and Initial Invalidity Contentions Regarding U.S. Pat. No. 10,376,407, Aug. 21, 2020, 277 pages.
Sage's Second Supplemental Invalidity Contentions Regarding U.S. Pat. Nos. 8,287,508, 10,226,375, 10,390,989, and 10,376,407, 292 pages.
Boehringer CareDry System—Second Generation for Non-Invasive Urinary Management for Females, Mar. 2021, 3 pgs.
Excerpts from the 508 (U.S. Pat. No. 8,278,508) Patent's Prosecution History, 2020, 99 pages.
Plaintiff's Opening Claim Construction Brief, Case No. 19-1508-MN, Oct. 16, 2020, 26 pages.
Plaintiff's Identification of Claim Terms and Proposed Constructions, Case No. 19-1508-MN, 3 pages.
PureWick's Response to Interrogatory No. 9 in *PureWick, LLC* v. *Sage Products, LLC*, Case No. 19-1508-MN, Mar. 23, 2020, 6 pages.
Sage's Preliminary Identification of Claim Elements and Proposed Constructions for U.S. Pat. Nos. 8,287,508, 10,226,376, 10,390,989 and 10,376,407, Case No. 19-1508-MN, 7 pages.
Decision Granting Institution of Inter Partes Review for patent No. 8,287,508, Case No. 2020-01426, Feb. 17, 2021, 39 pages.
Corrected Certificate of Service, Case No. IPR2020-01426, U.S. Pat. No. 8,287,508, 2020, 2 pages.
Declaration of Diane K. Newman Curriculum Vitae, Petition for Interparties Review, 2020, pp. 1-199.
"3 Devices Take Top Honors in Dare-to-Dream Medtech Design Contest", R+D Digest, Nov. 2013, 1 page.

(56) References Cited

OTHER PUBLICATIONS

"Advanced Mission Extender Device (AMDX) Products", Omni Medical Systems, Inc., 15 pages.
"AMXD Control Starter Kit Brochure", https://www.omnimedicalsys.com/index.php?page=products, Omni Medical, 8 pages.
"AMXDmax In-Flight Bladder Relief", Omni Medical; Omni Medical Systems, Inc., 2015.
"AMXDX—Advanced Mission Extender Device Brochure", Omni Medical, Omni Brochure—http://www.omnimedicalsys.com/uploads/AMXDFixedWing.pdf, 2 pages.
"External Urine Management for Female Anatomy", https://www.stryker.com/us/en/sage/products/sage-primafit.html, Jul. 2020, 4 pages.
"High Absorbancy Cellulose Acetate Electrospun Nanofibers for Feminine Hygiene Application", https://www.sciencedirect.com/science/article/abs/pii/S2352940716300701 ?via%3Dihub, Jul. 2016, 3 pages.
"How Period Panties Work", www.shethinx.com/pages/thinx-itworks, 2020, 10 pages.
"Hydrogel properties of electrospun polyvinylpyrrolidone and polyvinylpyrrolidone/poly(acrylic acid) blend nanofibers", https://pubs.rsc.org/en/content/articlelanding/2015/ra/c5ra07514a#!divAbstract, 2015, 5 pages.
"In Flight Bladder Relief", Omni Medical, Omni Presentation https://www.omnimedicalsys.com/uploads/AMXDmax_HSD.pdf, 14 pages.
"Making Women's Sanitary Products Safer and Cheaper", https://www.elsevier.com/connect/making-womens-sanitary-products-safer-and-cheaper, Sep. 2016, 10 pages.
"Novel Nanofibers Make Safe and Effective Absorbent for Sanitary Products", https://www.materialstoday.com/nanomaterials/news/nanofibers-make-safe-and-effective-absorbent/, Oct. 2016, 3 pages.
"Research and Development Work Relating to Assistive Technology Jun. 2005", British Department of Health, Nov. 2006, 40 pages.
"Step by Step How Ur24 WorksHome", http://medicalpatentur24.com, last accessed Dec. 6, 2017, Aug. 30, 2017, 4 pages.
"Underwear that absorbs your period", Thinx!, https://www.shethinx.com/pages/thinx-it-works last accessed Jun. 24, 2020, 7 pages.
"User & Maintenance Guide", Omni Medical, 2007, 16 pages.
"Winners Announced for Dare-to-Dream Medtech Design Challenge", https://www.mddionline.com/design-engineering/winners-announced-dare-dream-medtech-design-challenge, MD&DI, 2014, 4 pages.
Hollister, Female Urinary and Pouch and Male Urinary Pouch Brochure, 2011, 1 page.
Hollister, "Male Urinary Pouch External Collection Device", http://www.hollister.com/en/products/Continence-Care-Products/Urine-Collectors/Urine-Collection-Accessories/Male-Urinary-Pouch-External-Collection-Device, last accessed Feb. 8, 2018.
Hollister, "Retracted Penis Pouch by Hollister", Vitality Medical.com, https://www.vitalitymedical.com/hollister-retracted-penis-pouch.html last accessed Jun. 24, 2020, 6 pages.
Macaulay, et al., "A Noninvasive Continence Management System: Development and Evaluation of a Novel Toileting Device for Women", The Wound, Ostomy and Continence Nurses Society, vol. 34 No. 6, 2007, pp. 641-648.
Newman, et al., "The Urinary Incontinence Sourcebook", Petition for Interparties Review, 1997, 23 pages.
Newton, et al., "Measuring Safety, Effectiveness and Ease of Use of PureWick in the Management of Urinary Incontinence in Bedbound Women: Case Studies", Jan. 8, 2016, 11 pages.
Parmar, "10 Finalists Chosen for Dare-to-Dream Medtech Design Challenge (PureWick)", Design Services, Nov. 10, 2014, 3 pages.
Purewick, "Incontinence Relief for Women", Presentation, Sep. 23, 2015, 7 pages.
Pytlik, "Super Absorbent Polymers", University of Buffalo, http://www.courses.sens.buffalo.edu/ce435/Diapers/Diapers.html, accessed on Feb. 17, 2017.
Sachtman, "New Relief for Pilots? It Depends", Wired, https://www.wired.com/2008/05/pilot-relief/, 2008, 2 pages.
Advisory Action for U.S. Appl. No. 16/452,258 dated Oct. 26, 2022.
Advisory Action for U.S. Appl. No. 16/478,180 dated Sep. 21, 2022.
Advisory Action for U.S. Appl. No. 16/904,868 dated Jun. 15, 2022.
Advisory Action for U.S. Appl. No. 16/905,400 dated Feb. 16, 2022.
Corrected Notice of Allowability for U.S. Appl. No. 17/330,657 dated Dec. 9, 2021.
Final Office Action for U.S. Appl. No. 16/245,726 dated Nov. 25, 2022.
Final Office Action for U.S. Appl. No. 16/369,676 dated Dec. 5, 2022.
Final Office Action for U.S. Appl. No. 16/433,773 dated Oct. 25, 2022.
Final Office Action for U.S. Appl. No. 16/449,039 dated Aug. 1, 2022.
Final Office Action for U.S. Application No. 16/452, 145 dated Mar. 25, 2022.
Final Office Action for U.S. Appl. No. 16/452,258 dated Jun. 14, 2022.
Final Office Action for U.S. Appl. No. 16/478,180 dated Jun. 22, 2022.
Final Office Action for U.S. Appl. No. 16/904,868 dated Mar. 10, 2022.
Final Office Action for U.S. Appl. No. 16/905,400 dated Dec. 9, 2021.
Final Office Action for U.S. Appl. No. 17/662,700 dated Sep. 30, 2022.
International Search Report and Written Opinion from International Application No. PCT/IB2021/057173 dated Nov. 5, 2021.
International Search Report and Written Opinion from International Application No. PCT/US2020/057562 dated Jan. 27, 2021.
International Search Report and Written Opinion from International Application No. PCT/US2021/015024 dated May 18, 2021.
International Search Report and Written Opinion from International Application No. PCT/US2021/024162 dated Jul. 8, 2021.
International Search Report and Written Opinion from International Application No. PCT/US2021/026607 dated Jul. 29, 2021.
International Search Report and Written Opinion from International Application No. PCT/US2021/027422 dated Aug. 12, 2021.
International Search Report and Written Opinion from International Application No. PCT/US2021/027425 dated Aug. 11, 2021.
International Search Report and Written Opinion from International Application No. PCT/US2021/027917 dated Aug. 19, 2021.
International Search Report and Written Opinion from International Application No. PCT/US2021/035181 dated Sep. 16, 2021.
International Search Report and Written Opinion from International Application No. PCT/US2021/039866 dated Oct. 7, 2021.
International Search Report and Written Opinion from International Application No. PCT/US2021/043893 dated Nov. 22, 2021.
International Search Report and Written Opinion from International Application No. PCT/US2021/044699 dated Nov. 22, 2021.
International Search Report and Written Opinion from International Application No. PCT/US2021/045188 dated Jan. 26, 2022.
International Search Report and Written Opinion from International Application No. PCT/US2021/047536 dated Dec. 23, 2021.
International Search Report and Written Opinion from International Application No. PCT/US2021/048211 dated Dec. 22, 2021.
International Search Report and Written Opinion from International Application No. PCT/US2021/048661 dated Feb. 14, 2022.
International Search Report and Written Opinion from International Application No. PCT/US2021/049404 dated Jan. 18, 2022.
International Search Report and Written Opinion from International Application No. PCT/US2021/051456 dated Jan. 19, 2022.
International Search Report and Written Opinion from International Application No. PCT/US2021/053593 dated Apr. 11, 2022.
International Search Report and Written Opinion from International Application No. PCT/US2021/055515 dated Jan. 28, 2022.
International Search Report and Written Opinion from International Application No. PCT/US2021/056566 dated Feb. 11, 2022.
International Search Report and Written Opinion from International Application No. PCT/US2021/060993 dated Mar. 18, 2022.
International Search Report and Written Opinion from International Application No. PCT/US2021/062440 dated Mar. 28, 2022.
International Search Report and Written Opinion from International Application No. PCT/US2022/011108 dated Apr. 22, 2022.

(56) References Cited

OTHER PUBLICATIONS

International Search Report and Written Opinion from International Application No. PCT/US2022/011281 dated Apr. 25, 2022.
International Search Report and Written Opinion from International Application No. PCT/US2022/011419 dated Jun. 7, 2022.
International Search Report and Written Opinion from International Application No. PCT/US2022/011421 dated Jun. 13, 2022.
International Search Report and Written Opinion from International Application No. PCT/US2022/012794 dated May 3, 2022.
International Search Report and Written Opinion from International Application No. PCT/US2022/014285 dated Sep. 28, 2022.
International Search Report and Written Opinion from International Application No. PCT/US2022/014749 dated Sep. 28, 2022.
International Search Report and Written Opinion from International Application No. PCT/US2022/015026 dated Oct. 31, 2022.
International Search Report and Written Opinion from International Application No. PCT/US2022/015045 dated Sep. 9, 2022.
International Search Report and Written Opinion from International Application No. PCT/US2022/015073 dated Sep. 8, 2022.
International Search Report and Written Opinion from International Application No. PCT/US2022/015418 dated Nov. 11, 2022.
International Search Report and Written Opinion from International Application No. PCT/US2022/015471 dated May 16, 2022.
International Search Report and Written Opinion from International Application No. PCT/US2022/015492 dated Apr. 26, 2022.
International Search Report and Written Opinion from International Application No. PCT/US2022/015781 dated May 6, 2022.
International Search Report and Written Opinion from International Application No. PCT/US2022/016942 dated Jun. 8, 2022.
International Search Report and Written Opinion from International Application No. PCT/US2022/018170 dated May 31, 2022.
International Search Report and Written Opinion from International Application No. PCT/US2022/019254 dated Jun. 7, 2022.
International Search Report and Written Opinion from International Application No. PCT/US2022/019480 dated Jun. 13, 2022.
International Search Report and Written Opinion from International Application No. PCT/US2022/021103 dated Jun. 23, 2022.
International Search Report and Written Opinion from International Application No. PCT/US2022/022111 dated Oct. 26, 2022.
International Search Report and Written Opinion from International Application No. PCT/US2022/023594 dated Jul. 12, 2022.
International Search Report and Written Opinion from International Application No. PCT/US2022/026667 dated Aug. 22, 2022.
International Search Report and Written Opinion from International Application No. PCT/US2022/030685 dated Oct. 31, 2022.
International Search Report and Written Opinion from International Application No. PCT/US2022/031032 dated Sep. 9, 2022.
International Search Report and Written Opinion from International Application No. PCT/US2022/032424 dated Oct. 11, 2022.
International Search Report and Written Opinion from International Application No. PCT/US2022/034457 dated Oct. 12, 2022.
Issue Notification for U.S. Application No. 16,905,400 dated Nov. 30, 2022.
Issue Notification for U.S. Appl. No. 17/088,272 dated Jun. 15, 2022.
Issue Notification for U.S. Appl. No. 17/330,657 dated Jun. 22, 2022.
Non-Final Office Action for U.S. Appl. No. 16/245,726 dated Jan. 21, 2022.
Non-Final Office Action for U.S. Appl. No. 16/369,676 dated Mar. 31, 2022.
Non-Final Office Action for U.S. Appl. No. 16/433,773 dated Apr. 21, 2022.
Non-Final Office Action for U.S. Appl. No. 16/449,039 dated Dec. 8, 2021.
Non-Final Office Action for U.S. Appl. No. 16/452,145 dated Sep. 28, 2021.
Non-Final Office Action for U.S. Appl. No. 16/452,258 dated Sep. 28, 2021.
Non-Final Office Action for U.S. Appl. No. 16/478,180 dated Dec. 20, 2022.
Non-Final Office Action for U.S. Appl. No. 16/478,180 dated Oct. 22, 2021.
Non-Final Office Action for U.S. Appl. No. 16/899,956 dated Sep. 2, 2021.
Non-Final Office Action for U.S. Appl. No. 16/904,868 dated Oct. 5, 2021.
Non-Final Office Action for U.S. Appl. No. 16/905,400 dated Apr. 27, 2022.
Non-Final Office Action for U.S. Appl. No. 17/051,550 dated Dec. 15, 2022.
Non-Final Office Action for U.S. Appl. No. 17/330,657 dated Aug. 11, 2021.
Non-Final Office Action for U.S. Appl. No. 17/451,345 dated Dec. 7, 2022.
Non-Final Office Action for U.S. Appl. No. 17/662,700 dated Jul. 22, 2022.
Non-Final Office Action for U.S. Appl. No. 29/741,751 dated Jan. 18, 2022.
Notice of Allowance for U.S. Appl. No. 16/449,039 dated Dec. 15, 2022.
Notice of Allowance for U.S. Appl. No. 16/899,956 dated Apr. 19, 2022.
Notice of Allowance for U.S. Appl. No. 16/899,956 dated Aug. 10, 2022.
Notice of Allowance for U.S. Appl. No. 16/899,956 dated Dec. 1, 2022.
Notice of Allowance for U.S. Appl. No. 16/899,956 dated Dec. 29, 2021.
Notice of Allowance for U.S. Appl. No. 16/905,400 dated Aug. 17, 2022.
Notice of Allowance for U.S. Appl. No. 17/088,272 dated Mar. 4, 2022.
Notice of Allowance for U.S. Appl. No. 17/088,272 dated Nov. 24, 2021.
Notice of Allowance for U.S. Appl. No. 17/330,657 dated Mar. 16, 2022.
Notice of Allowance for U.S. Appl. No. 17/330,657 dated Nov. 26, 2021.
Notice of Allowance for U.S. Appl. No. 29/741,751 dated Jun. 9, 2022.
Restriction Requirement for U.S. Appl. No. 16/433,773 dated Dec. 7, 2021.
U.S. Appl. No. 14/625,469, filed Feb. 28, 2015.
U.S. Appl. No. 14/947,759, filed Nov. 20, 2015.
U.S. Appl. No. 14/952,591, filed Nov. 25, 2015.
U.S. Application No. 15/384, 196 filed Dec. 19, 2016.
U.S. Appl. No. 16/245,726, filed Jan. 11, 2019.
U.S. Appl. No. 17/394,055, filed Aug. 4, 2021.
U.S. Appl. No. 17/412,864, filed Aug. 26, 2021.
U.S. Appl. No. 17/446,654, filed Sep. 1, 2021.
U.S. Appl. No. 17/447,123, filed Sep. 8, 2021.
U.S. Appl. No. 17/450,864, filed Oct. 14, 2021.
U.S. Appl. No. 17/451,345, filed Oct. 19, 2021.
U.S. Appl. No. 17/451,354, filed Oct. 19, 2021.
U.S. Appl. No. 17/453,260, filed Nov. 2, 2021.
U.S. Appl. No. 17/453,560, filed Nov. 4, 2021.
U.S. Appl. No. 17/494,578, filed Oct. 5, 2021.
U.S. Appl. No. 17/501,591, filed Oct. 14, 2021.
U.S. Appl. No. 17/595,747, filed Nov. 23, 2021.
U.S. Appl. No. 17/597,408, filed Jan. 5, 2022.
U.S. Appl. No. 17/597,673, filed Jan. 18, 2022.
U.S. Application No. 17/614, 173 filed Nov. 24, 2021.
U.S. Appl. No. 17/631,619, filed Jan. 31, 2022.
U.S. Appl. No. 17/645,821, filed Dec. 23, 2021.
U.S. Appl. No. 17/646,771, filed Jan. 3, 2022.
U.S. Appl. No. 17/653,314, filed Mar. 3, 2022.
U.S. Appl. No. 17/653,920, filed Mar. 8, 2022.
U.S. Application No. 17/654, 156 filed Mar. 9, 2022.
U.S. Appl. No. 17/655,464, filed Mar. 18, 2022.
U.S. Appl. No. 17/657,474, filed Mar. 31, 2022.
U.S. Appl. No. 17/661,090, filed Apr. 28, 2022.

(56) References Cited

OTHER PUBLICATIONS

U.S. Appl. No. 17/662,700, filed May 10, 2022.
U.S. Appl. No. 17/663,046, filed May 12, 2022.
U.S. Appl. No. 17/664,914, filed May 25, 2022.
U.S. Appl. No. 17/749,340, filed May 20, 2022.
U.S. Appl. No. 17/754,736, filed Apr. 11, 2022.
U.S. Appl. No. 17/756,201, filed May 19, 2022.
U.S. Appl. No. 17/758,152, filed Jun. 29, 2022.
U.S. Appl. No. 17/758,316, filed Jul. 1, 2022.
U.S. Appl. No. 17/759,697, filed Jul. 28, 2022.
U.S. Appl. No. 17/878,268, filed Aug. 1, 2022.
U.S. Application No. 17/907, 125 filed Sep. 23, 2022.
U.S. Application No. 17/912, 147 filed Sep. 16, 2022.
U.S. Appl. No. 17/929,887, filed Sep. 6, 2022.
U.S. Appl. No. 17/930,238, filed Sep. 7, 2022.
U.S. Appl. No. 17/933,590, filed Sep. 20, 2022.
U.S. Appl. No. 17/996,064, filed Oct. 12, 2022.
U.S. Application No. 17/996, 155 filed Oct. 13, 2022.
U.S. Appl. No. 17/996,253, filed Oct. 14, 2022.
U.S. Appl. No. 17/996,468, filed Oct. 18, 2022.
U.S. Appl. No. 17/996,556, filed Oct. 19, 2022.
U.S. Appl. No. 17/999,648, filed Nov. 22, 2022.
U.S. Appl. No. 61/955,537, filed Mar. 19, 2014.
U.S. Appl. No. 62/082,279, filed Nov. 20, 2014.
U.S. Appl. No. 62/084,078, filed Nov. 25, 2014.
U.S. Appl. No. 62/414,963, filed Oct. 31, 2016.
U.S. Appl. No. 62/485,578, filed Apr. 14, 2017.
U.S. Appl. No. 62/923,279, filed Oct. 18, 2019.
U.S. Appl. No. 62/926,767, filed Oct. 28, 2019.
U.S. Appl. No. 62/935,337, filed Nov. 14, 2019.
U.S. Application No. 62/967, 158 filed Jan. 26, 2020.
U.S. Appl. No. 62/967,977, filed Jan. 30, 2020.
U.S. Appl. No. 62/991,754, filed Mar. 19, 2020.
U.S. Appl. No. 63/008,112, filed Apr. 10, 2020.
U.S. Appl. No. 63/033,310, filed Jun. 2, 2020.
U.S. Appl. No. 63/047,374, filed Jul. 2, 2020.
U.S. Appl. No. 63/071,821, filed Aug. 28, 2020.
U.S. Appl. No. 63/073,553, filed Sep. 2, 2020.
U.S. Appl. No. 63/088,539, filed Oct. 7, 2020.
U.S. Appl. No. 63/094,646, filed Oct. 21, 2020.
U.S. Appl. No. 63/109,084, filed Nov. 3, 2020.
U.S. Appl. No. 63/133,892, filed Jan. 5, 2021.
U.S. Appl. No. 63/138,878, filed Jan. 19, 2021.
U.S. Application No. 63/159, 186 filed Mar. 10, 2021.
U.S. Appl. No. 63/159,280, filed Mar. 10, 2021.
U.S. Appl. No. 63/191,558, filed May 21, 2021.
U.S. Appl. No. 63/192,289, filed May 24, 2021.
U.S. Appl. No. 63/193,891, filed May 27, 2021.
U.S. Appl. No. 63/208,262, filed Jun. 8, 2021.
U.S. Appl. No. 63/215,017, filed Jun. 25, 2021.
U.S. Appl. No. 63/228,244, filed Aug. 2, 2021.
U.S. Appl. No. 63/230,897, filed Aug. 9, 2021.
U.S. Appl. No. 63/238,457, filed Aug. 30, 2021.
U.S. Appl. No. 63/238,477, filed Aug. 30, 2021.
U.S. Appl. No. 63/241,328, filed Sep. 7, 2021.
U.S. Appl. No. 63/241,562, filed Sep. 8, 2021.
U.S. Appl. No. 63/241,564, filed Sep. 8, 2021.
U.S. Appl. No. 63/241,575, filed Sep. 8, 2021.
U.S. Appl. No. 63/246,972, filed Sep. 22, 2021.
U.S. Appl. No. 63/247,375, filed Sep. 23, 2021.
U.S. Appl. No. 63/247,478, filed Sep. 23, 2021.
U.S. Appl. No. 63/247,491, filed Sep. 23, 2021.
U.S. Appl. No. 63/299,208, filed Jan. 13, 2022.
"Rising Warrior Insulated Gallon Jug Cover", https://www.amazon.com/Rising-Warrior-Insulated-Sleeve, 2021, 2 pages.
"Urine Bag Cover-Catheter Bag Cover 2000 ml vol. Medline Style-Multiple Sclerosis-Spine Injury-Suprapublic Catheter-Bladder Incontinence", https://www.etsy.com/listing/1142934658/urine-bag-cover-caatheter-bag-cover-2000, 2022, 1 page.
"Vinyl Dust Cover, Janome #741811000, Janome, Sewing Parts Online", https://www.sewingpartsonline.com/vinyl- dust-cover-janome-74181000, 2020, 2 pages.
Ali, "Sustainability Assessment: Seventh Generation Diapers versus gDiapers", The University of Vermont, Dec. 6, 2011, pp. 1-31.
Autumn , et al., "Frictional adhesion: a new angle on gecko attachment", The Journal of Experimental Biology, 2006, pp. 3569-3579.
Cañas , et al., "Effect of nano- and micro-roughness on adhesion of bioinspired micropatterned surfaces", Acta Biomaterialia 8, 2012, pp. 282-288.
Chaudhary , et al., "Bioinspired dry adhesive: Poly(dimethylsiloxane) grafted with poly(2-ethylhexyl acrylate) brushes", European Polymer Journal, 2015, pp. 432-440.
Dai, et al., "Non-sticky and Non-slippery Biomimetic Patterned Surfaces", Journal of Bionic Engineering, Mar. 2020, pp. 326-334.
Espinoza-Ramirez, "Nanobiodiversity and Biomimetic Adhesives Development: From Nature to Production and Application", Journal of Biomaterials and Nanobiotechnology, pp. 78-101, 2019.
Hwang , et al., "Multifunctional Smart Skin Adhesive Patches for Advanced Health Care", Adv. Healthcare Mater, 2018, pp. 1-20.
Jagota, et al., "Adhesion, friction, and compliance of bio-mimetic and bio-inspired structured interfaces", Materials Science and Engineering, 2011, pp. 253-292.
Jeong , et al., "A nontransferring dry adhesive with hierarchical polymer nanohairs", PNAS, Apr. 7, 2009, pp. 5639-5644.
Jeong , et al., "Nanohairs and nanotubes: Efficient structural elements for gecko-inspired artificial dry adhesives", Science Direct, 2009, pp. 335-346.
Karp, et al., "Dry solution to a sticky problem", Nature., 2011, pp. 42-43.
Lee, et al., "Continuous Fabrication of Wide-Tip Microstructures for Bio-Inspired Dry Adhesives via Tip Inking Process", Journal of Chemistry, Jan. 2, 2019, pp. 1-5.
Parness , et al., "A microfabricated wedge-shaped adhesive array displaying gecko-like dynamic adhesion, directionality", J.R. Soc. Interface, 2009, pp. 1223-1232.
Tsipenyuk , et al., "Use of biomimetic hexagonal surface texture in friction against lubricated skin", Journal of The Royal Society - Interface, 2014, pp. 1-6.
Advisory Action for U.S. Appl. No. 16/245,726 dated Apr. 19, 2023.
Advisory Action for U.S. Appl. No. 16/369,676 dated Mar. 24, 2023.
Advisory Action for U.S. Appl. No. 16/433,773 dated Feb. 15, 2023.
Advisory Action for U.S. Appl. No. 17/662,700 dated Jan. 30, 2023.
Final Office Action for U.S. Appl. No. 17/051,399 dated Mar. 9, 2023.
Final Office Action for U.S. Appl. No. 17/451,345 dated May 3, 2023.
International Search Report and Written Opinion from International Application No. PCT/US2022/015420 dated Nov. 18, 2022.
International Search Report and Written Opinion from International Application No. PCT/US2022/018159 dated Dec. 12, 2022.
International Search Report and Written Opinion from International Application No. PCT/US2022/034744 dated Dec. 9, 2022.
International Search Report and Written Opinion from International Application No. PCT/US2022/039018 dated Jan. 10, 2023.
International Search Report and Written Opinion from International Application No. PCT/US2022/039022 dated Jan. 10, 2023.
International Search Report and Written Opinion from International Application No. PCT/US2022/039711 dated Jan. 12, 2023.
International Search Report and Written Opinion from International Application No. PCT/US2022/039714 dated Nov. 22, 2022.
International Search Report and Written Opinion from International Application No. PCT/US2022/041085 dated Mar. 16, 2023.
International Search Report and Written Opinion from International Application No. PCT/US2022/042719 dated Dec. 5, 2022.
International Search Report and Written Opinion from International Application No. PCT/US2022/042725 dated Dec. 19, 2022.
International Search Report and Written Opinion from International Application No. PCT/US2022/044107 dated Dec. 23, 2022.
International Search Report and Written Opinion from International Application No. PCT/US2022/044212 dated Jan. 20, 2023.

(56) References Cited

OTHER PUBLICATIONS

International Search Report and Written Opinion from International Application No. PCT/US2022/044243 dated Feb. 24, 2023.
Issue Notification for U.S. Appl. No. 16/899,956 dated Mar. 29, 2023.
Non-Final Office Action for U.S. Appl. No. 16/433,773 dated Apr. 11, 2023.
Non-Final Office Action for U.S. Appl. No. 16/449,039 dated Apr. 27, 2023.
Non-Final Office Action for U.S. Appl. No. 16/452,145 dated Mar. 28, 2023.
Non-Final Office Action for U.S. Appl. No. 16/452,258 dated Apr. 26, 2023.
Non-Final Office Action for U.S. Appl. No. 16/904,868 dated Mar. 15, 2023.
Non-Final Office Action for U.S. Appl. No. 17/051,585 dated Mar. 29, 2023.
Non-Final Office Action for U.S. Appl. No. 17/179,116 dated Mar. 24, 2023.
Non-Final Office Action for U.S. Appl. No. 17/444,792 dated Feb. 10, 2023.
Non-Final Office Action for U.S. Appl. No. 17/446,256 dated Apr. 13, 2023.
Non-Final Office Action for U.S. Appl. No. 17/448,811 dated Mar. 1, 2023.
Non-Final Office Action for U.S. Appl. No. 17/451,354 dated May 3, 2023.
Non-Final Office Action for U.S. Appl. No. 17/453,260 dated Mar. 14, 2023.
Non-Final Office Action for U.S. Appl. No. 17/501,591 dated Apr. 25, 2023.
Non-Final Office Action for U.S. Appl. No. 17/653,137 dated Apr. 7, 2023.
Non-Final Office Action for U.S. Appl. No. 17/655,464 dated Mar. 14, 2023.
Notice of Allowance for U.S. Appl. No. 17/662,700 dated Mar. 28, 2023.
Notice of Allowance for U.S. Appl. No. 17/663,046 dated Jan. 30, 2023.
Restriction Requirement for U.S. Appl. No. 17/326,980 dated Mar. 20, 2023.
Restriction Requirement for U.S. Appl. No. 17/446,256 dated Jan. 23, 2023.
Restriction Requirement for U.S. Appl. No. 17/646,771 dated Apr. 6, 2023.
Text Messages to Lorena Eckert Re Prototype PureWick Holder dated Apr. 16, 2022.
U.S. Appl. No. 18/003,029, filed Dec. 22, 2022.
U.S. Appl. No. 18/006,807, filed Jan. 25, 2023.
U.S. Appl. No. 18/007,105, filed Jan. 27, 2023.
U.S. Appl. No. 18/041,109, filed Feb. 9, 2023.
U.S. Appl. No. 18/042,842, filed Feb. 24, 2023.
U.S. Appl. No. 18/043,618, filed Mar. 1, 2023.
U.S. Appl. No. 18/115,444, filed Feb. 28, 2023.
U.S. Appl. No. 18/134,857, filed Apr. 14, 2023.
U.S. Appl. No. 18/140,163, filed Apr. 27, 2023.
U.S. Appl. No. 18/140,751, filed Apr. 28, 2023.
U.S. Appl. No. 18/164,800, filed Feb. 6, 2023.
U.S. Appl. No. 18/246,121, filed Mar. 21, 2023.
U.S. Appl. No. 18/247,986, filed Apr. 5, 2023.
U.S. Appl. No. 18/299,788, filed Apr. 13, 2023.
U.S. Appl. No. 63/308,190, filed Feb. 9, 2022.
"AMXD Control Starter Kit", Omni Medical Systems, Inc., 1 page.
AMXDmax Advanced Mission Extender Device User & Maintenance Guide, Omni Medical, Jan. 11, 2010, 10 pages.
"AMXDmax Development History 2002-2014", Omni Medical Systems, Inc., 2 pages.
"Combat Force Multiplier in Flight Bladder Relief Cockpit Essential Equipment Brochure", Omni Medical, 20 pages.
"GSA Price List", Omni Medical, Apr. 2011, 2 pages.
"Letter to Mark Harvie of Omni Measurement Systems", Department of Veterans Affairs, Nov. 1, 2007, 11 pages.
"PureWick Corporation v. Sage Products, LLC Transcripts vol. 1", Mar. 28, 2022, 99 pages.
"PureWick Corporation v. Sage Products, LLC Transcripts vol. 2", Mar. 29, 2022, 106 pages.
"PureWick Corporation v. Sage Products, LLC Transcripts vol. 3", Mar. 30, 2022, 115 pages.
"PureWick Corporation v. Sage Products, LLC Transcripts vol. 4", Mar. 31, 2022, 117 pages.
"PureWick Corporation v. Sage Products, LLC Transcripts vol. 5", Apr. 1, 2022, 72 pages.
"Revised AMXDmax Advanced Mission Extender Device User & Maintenance Guide", Omni Medical Systems, Oct. 8, 2019, 52 pages.
Pieper, et al., "An external urine-collection device for women: A clinical trial", Journal of ER Nursing, vol. 20, No. 2, March/Apr. 1993, pp. 51-55.
Mnas, , "A Solution For An Awkward—But Serious—Subject", http://www.aero-news.net/index.cfm?do=main.textpost&id=69ae2bb1- 838b-4098-a7b5-7flbb2505688 last accessed Feb. 8, 2021, 3 pages.

* cited by examiner

URINE STORAGE CONTAINER HANDLE AND LID ACCESSORIES

CROSS-REFERENCE TO RELATED APPLICATIONS

This application claims priority to U.S. Provisional Patent Application No. 63/076,477 filed on Sep. 10, 2020, the disclosure of which is incorporated herein, in its entirety, by this reference.

BACKGROUND

Portable vacuums and urine storage containers are used to pull urine and other fluids from urine collection devices for storage in the urine storage containers. When full, these urine storage containers can be heavy and cumbersome for caregivers to transport and empty for disposal of the fluid. Undesirable spilling of the contents of the fluid collection device may occur during movement of the fluid collection containers.

Thus, users and manufacturers of fluid storage systems continue to seek new and improved devices, systems, and methods to collect and dispose of urine.

SUMMARY

Embodiments disclosed herein are urine storage container handle and/or lid accessories, and systems and methods including urine storage container handle and/or lid accessories. In an embodiment, a fluid storage assembly for storing and disposing of urine collected from a user includes a urine storage container, a lid, and a handle accessory. The urine storage container configured to store urine collected from the user and having an open end and a closed end distal to the open end. The lid is secured or securable to the open end of the urine storage container. The lid includes a vacuum port configured to attach to a vacuum conduit in fluid communication with a vacuum source, a urine collection port configured to attach to a urine collection conduit in fluid communication with a urine collection device such that urine collected from the user enters the urine storage container through the urine collection port when the vacuum source is activated, a urine disposal port sized and dimensioned to pour urine in the urine storage container therethrough when the lid is secured to the urine storage container, and a cap secured or securable to the urine disposal port. The handle accessory includes a sleeve and at least one handle. The sleeve is shaped and sized complimentary to at least a portion of the urine storage container.

In an embodiment, a urine storage system for storing and disposing of urine collected from a user includes a urine storage container, a lid, a vacuum conduit, and a urine collection conduit. The urine storage container at least partially defines a chamber configured to store urine collected from the user and having an open end and a closed end distal to the open end. The lid is secured or securable to the open end of the urine storage container. The lid includes a vacuum port, a urine collection port, a urine disposal port sized and dimensioned to pour the urine in the urine storage container therethrough when the lid is secured to the urine storage container, and a cap secured or securable to the urine disposal port. The vacuum conduit is in fluid communication with a vacuum source and attached to the vacuum port effective to provide fluid communication between the vacuum source and the chamber of the urine storage container. The urine collection conduit is in fluid communication with a urine collection device and attached to the urine collection port effective to provide fluid communication between the chamber and the urine collection device such that urine collected from the user enters the chamber of the urine storage container through the urine collection port when the vacuum source is activated.

In an embodiment, a method of assembling a urine storage system for storing and disposing of urine collected from a user is described. The method includes securing a lid to an open end of a urine storage container at least partially defining a chamber configured to store urine collected from a user. The lid includes a vacuum port, a urine collection port, a urine disposal port sized and dimensioned to pour the urine in the urine storage container therethrough, and a cap secured to the urine disposal port. The method also includes securing a vacuum conduit to the vacuum port on the lid effective to provide fluid communication between a vacuum source and the chamber of the urine storage container. The method also includes securing a urine collection conduit to the urine collection port effective provide fluid communication between a urine collection device and the chamber such that urine collected from the user enters the chamber of the urine storage container through the urine collection port when the vacuum source is activated.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Figure 1A:
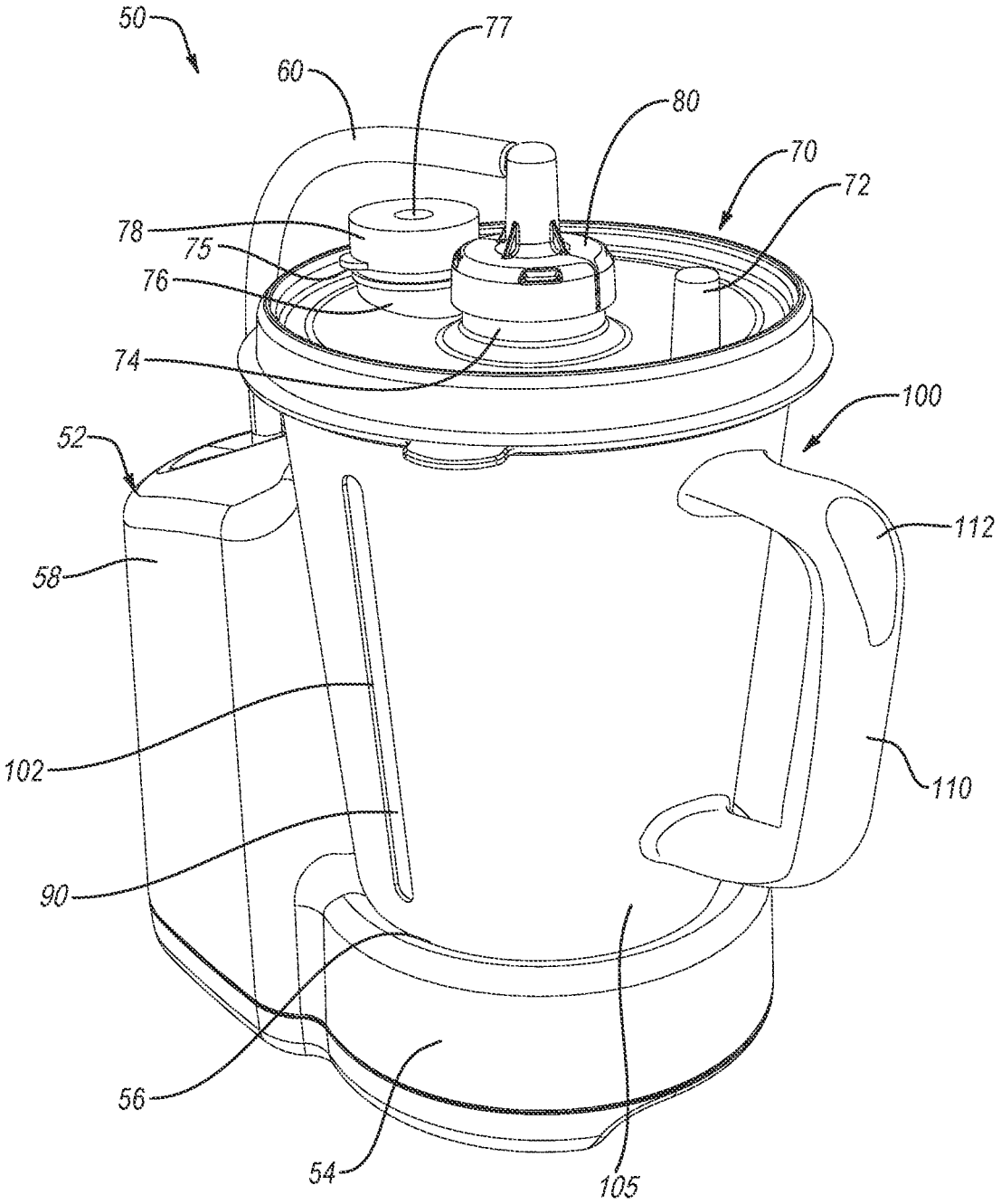
FIG. 1A is an isometric view of a urine storage system including a portable vacuum, a urine storage container, a urine storage container handle accessory, and a lid, according to an embodiment.

Portable vacuums and urine storage containers or canisters are used to pull urine and other fluids from urine collection devices for storage in the urine storage containers. Conventional urine containers typically do not include a handle, and the urine storage container can be heavy and cumbersome for caregivers to carry without a handle for emptying and disposal of the urine. The urine storage container handle accessories described herein are configured to secure to a urine storage container for easier and safer transport of the urine storage container when the urine storage container contains urine or other fluids. In some embodiments, a urine storage container handle accessory at least partially wraps around at least a top portion of a urine storage container under a rim or lip on the urine storage container. The handle accessory can remain on the urine storage container while the container is in use (collecting fluids). Once tubing is disconnected from the lid of the storage container, the storage container may be lifted straight up out of the portable vacuum base with the handle accessory and carried away for disposal of the urine.

Additionally, conventional lids for urine storage containers must be completely removed from the storage container before the storage container can be emptied. Removing the lid from the storage container requires enough force to frequently cause urine to spill from the storage container during the process. Moreover, when the entire lid is removed from the storage container, there is a higher risk that all of the urine may be spilled from the storage container if the user/caregiver drops the storage container. When the entire lid is removed from the storage container, there also is a higher risk that urine sloshes out of the storage container on the way to empty the storage container. Described herein are embodiments of one or more lids for urine storage containers that include a urine disposal port on the lid that allows urine to be removed from the storage container without removing the lid. In use, a user/caregiver may remove a cap from the urine disposal port on the lid and pour the urine out of the storage container through the urine disposal port without removing the lid. The cap may be easy to remove and reattach to the urine disposal port. The cap may include an overhanging flap that allows the user/caregiver to either push the tab to open the urine disposal port or allows the user/caregiver to grasp the cap to open the urine disposal port.

This urine disposal port also may be used to introduce a cleaning solution into the storage container to clean the storage container between uses. For example, after pouring the urine out of the storage container, water with soap or another cleaning agent can be poured into the storage container through the urine disposal port to clean in the inside of the storage container and the lid between uses. After the inside of the container is cleaned, the cleaning solution and water can then be dumped out of the storage container through the urine disposal port.

The urine storage container handle and lid accessories described herein may be used in urine storage systems. The fluid storage systems may include a fluid collection device, a fluid storage container, and a portable vacuum source. Fluid (e.g., urine or other bodily fluids) collected in the fluid collection device may be removed from the urine collection device via a conduit which protrudes into an interior region of the urine collection device. For example, a first open end of the conduit may extend into the urine collection device to a reservoir therein. The second open end of the conduit may extend into the fluid collection device or the portable vacuum source. The suction force may be introduced into the interior region of the fluid collection device via the first open end of the conduit responsive to a suction (e.g., vacuum) force applied at the second end of the conduit. The suction force may be applied to the second open end of the conduit by the portable vacuum source either directly or indirectly.

In some embodiments, the urine collection devices may be shaped and sized to be positioned adjacent to the opening of a female or male urethra. Embodiments of urine collection devices that may be used with embodiments of the urine storage systems disclosed herein are disclosed in International Application No. PCT/US19/29616 filed on Apr. 29, 2019; U.S. patent application Ser. No. 16/369,676 filed on Mar. 29, 2019; and U.S. patent application Ser. No. 16/478,180 filed Jul. 16, 2019, the disclosure of each of which is incorporated herein, in its entirety, by this reference. A conduit may extend into the urine collection device. In some embodiments, the portable vacuum source may be disposed in or on the urine collection device. In such embodiments, the conduit may extend from the urine collection device and attach to the portable vacuum source at a first point therein. An additional conduit may attach to the portable vacuum source at a second point thereon and may extend out of the urine collection device, and may attach to the fluid storage container. Accordingly, a vacuum (e.g., suction) may be drawn through the fluid collection device via the fluid storage container. Fluid, such as urine, may be drained from the fluid collection device using the portable vacuum source.

FIG. 1A is an isometric view of a urine storage system 50 including a portable vacuum system 52, a urine storage container handle accessory 100, a urine (or other fluid) storage container 90 (visible in FIG. 1A through an elongated opening 102 in the handle accessory 100), and a lid 70. The portable vacuum system 52 may include a housing holding a portable vacuum therein. For example, a portable vacuum may be housed in a body 58 of the portable vacuum system 52. The portable vacuum system 52 also may include a base 54 configured to receive a portion of the storage container 90. For example, the base 54 may include a recessed portion 56 shaped complementary to a portion of the storage container 90. FIG. 1C, for example, shows a bottom portion of the storage container 90 that may rest within the recessed portion 56 to station the storage container 90 on the base 54. The storage container 90 may at least partially define a chamber therein and include an open end and a closed bottom end (shown in FIG. 1C) distal to the open end. In some embodiments, the storage container 90 tapers between the open end and the closed end. For example, the storage container 90 may taper continuously or partially between the open end and the closed end. The storage container 90 may include a disposable storage container, such as a polypropylene storage container.

Figure 1B:
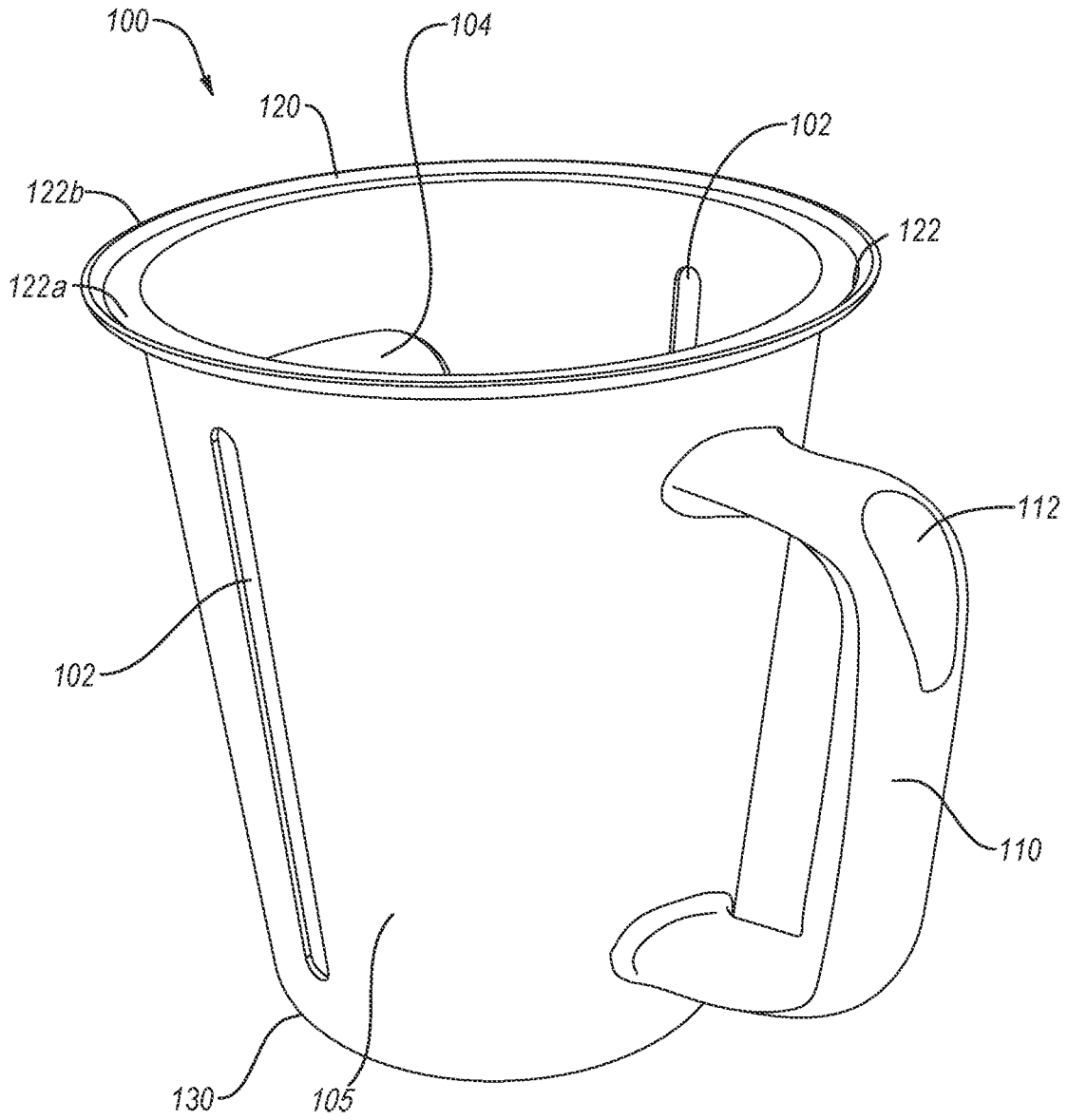
FIG. 1B is an isometric view of the urine storage container handle accessory of FIG. 1A.
Figure 1C:
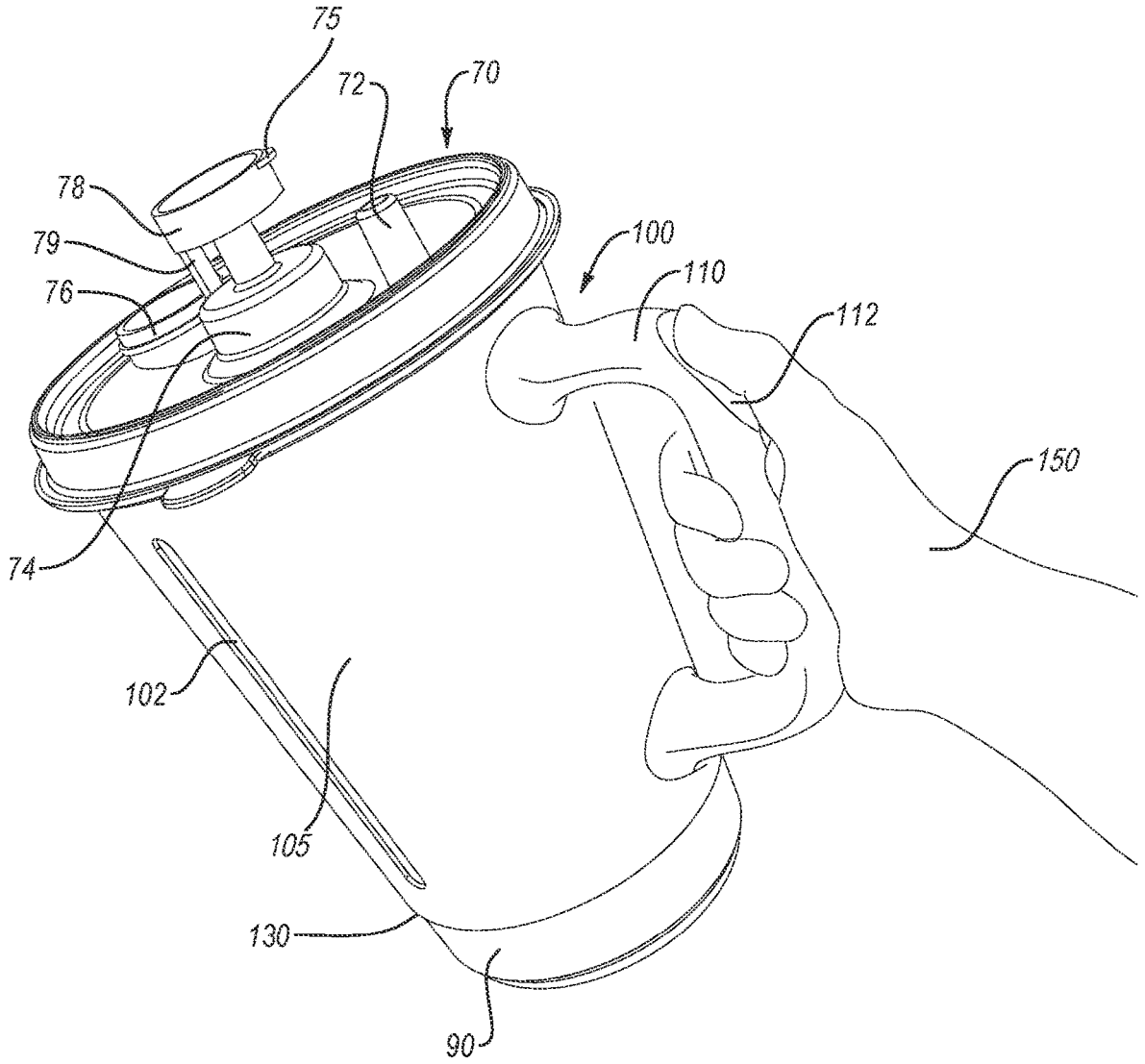
FIG. 1C is an isometric view of the urine storage container handle accessory and the lid of FIG. 1A in use.

FIG. 1B is an isometric view of a urine storage container handle accessory 100 according to an embodiment. The handle accessory 100 includes a sleeve 105 having a first end region 120 and a second end region 130. The first end region 120 and the second end region 130 may both be open such that the storage container 90 can be inserted through the first end region 120 and the second end region 130. In some embodiments, the sleeve 105 may be sized such that the bottom closed end of the storage container 90 extends partially from the open second end region 130 of the sleeve 100 (shown in FIG. 1C). In many embodiments, the sleeve 105 tapers at least partially between the first end region 120 and the second end region 130 complementary to the storage container 90. For example, the sleeve 105 may taper continuously or partially between the first end region 120 and the second end region 130. The material of the sleeve 105 may include any of a variety of different materials, including plastic, rubber, metal, wood, or combinations thereof.

In some embodiments, the sleeve 105 includes at least one elongated opening 102 extending at least partially between the first end region 120 and the second end region 130. For example, the sleeve 105 includes two elongated openings 102 extending at least partially between the first end region 120 and the second end region 130. The elongated opening is positioned on the sleeve 105 to allow a user or caregiver to view the contents in the storage container 90. For example, a user or caregiver may desire to know an approximate volume of fluids in the storage container 90 or how full the storage container 90 is. A user or caregiver also may desire to know general characteristics of the fluid in the storage container 90, i.e., if the urine is discolored, includes blood, etc. The elongated opening 102 in the sleeve 105 allows a user or caregiver to instantly view the contents in the storage container 90 even when the handle accessory 100 is positioned around the storage container 90, thereby allowing a user or caregiver to instantly assess the fluid in the storage container 90. In some embodiments, the elongated opening 102 includes a transparent or translucent material.

In some embodiments, the sleeve 105 includes an outer periphery and defines a gap 104 in the outer periphery extending longitudinally from the second end region 130 at least halfway to the first end region 120. The gap 104 in the sleeve 105 may extend at least about 45 degrees, at least about 60 degrees, or at least about 75 degrees on the outer periphery of the sleeve 105. The gap 104 may be positioned on the sleeve 105 to be adjacent to the body 58 of the portable vacuum system 52 and/or to accommodate a portion of the body 58 positioned adjacent to the storage container 90 when the storage container 90 is positioned in recessed portion 56.

The handle accessory 100 also includes a handle 110 secured or securable to the sleeve 105. The handle 110 may include a variety of configurations, such as a C- or U-shaped handle secured or securable to the sleeve 105 at two ends of the handle 110, an L-shaped handle secured or securable to the sleeve 105 at only one end, a handle pivotably or hingedly secured to the sleeve 105, or combinations thereof. The handle accessory 100 includes a C- or U-shaped handle 110 secured to the sleeve 105 at two ends of the handle 110. In some embodiments, one end of the handle 110 may be secured to the first end region 120 and another end of the handle 110 may be secured to the second end region 130. In some embodiments, the sleeve 105 is separated into two portions: a first portion at the first end region 120 secured to a first end of the handle 110 and a second portion at the second end region 130 secured to a second end of the handle 110.

The handle 110 may be positioned in various positions on the sleeve 105. For example, the handle 110 is positioned on the sleeve 105 between the two elongated openings 102 and generally distal or opposite to the gap 104. In other embodiments, the handle 110 may be positioned elsewhere on the sleeve 105. The handle 110 also may include a thumb-grip 112 on an outer surface of the handle 110, such as a top corner portion of the outer surface of the handle 110.

In some embodiments, storage container 90 includes an outward protruding lip or rim (shown in FIGS. 6A and 6B) proximate to the open end of the storage container 90. The handle accessory 100 may include an outward protruding flange 122 proximate to the first end region 120 positioned to at least partially interface the lip of the storage container 90. The flange 122 may include a first portion 122*a* adjacent to the sleeve 105 that interfaces the lip of the storage container 90. The flange 122 also may include a second portion 122*b* angled upward from the first portion 122*a*. The second portion 122*b* may be positioned to at least partially cover an outer periphery of the lip and/or guide the lip into position on the first portion 122*a*. The second portion 122*b* also may be used with a pivoting handle to lock the handle accessory to the storage container 90. In some embodiments, the flange 122 may be absent, and the sleeve 105 may include a locking tab configured to releasably secure to the lip of the storage container 90 and prevent the sleeve 105 from sliding down the storage container 90.

Returning to FIG. 1A, the urine storage system 50 also include a lid 70 detachably secured or securable to the open end of storage container 90. The lid 70 includes a first or urine collection port 72 configured to attach to a conduit to provide fluid communication between a urine collection device positioned on the user and the storage container 90. The lid 70 also includes a second or vacuum port 74 configured to attach to a conduit 60 to provide fluid communication between the vacuum in the portable vacuum system 52 and the urine storage container 90. An adapter 80 also may be secured or securable to the vacuum port 74, the adapter 80 being configured to attach directly to the conduit 60.

The lid 70 also includes an third or urine disposal port 76. The urine disposal port 76 may be positioned on the lid 70 spaced from the urine collection port 72 with the vacuum port 74 between the urine collection port 72 and the urine disposal port 76. In some embodiments, the vacuum port 74 may be positioned proximate to the urine disposal port 76, and the urine collection port 72 may be positioned at any other location on the lid 70. Other arrangements can also be used.

The urine disposal port 76 is sized to allow a user or caregiver to pour urine out of the storage container through the urine disposal port without removing the lid 70. The urine disposal port 76 also may be sized to allow easy and efficient introduction of a cleaning solution into the storage container 90 to clean the storage container 90 between uses. After the inside of the storage container 90 and/or the lid 70 is cleaned, the cleaning solution and water can then be dumped out of the storage container 90 through the urine disposal port 76. The urine disposal port 76 may be larger (e.g., have a greater diameter) than at least one (e.g., both) of the urine collection port 72 and the vacuum port 74. In some embodiments, the urine disposal port 76 has a diameter of at least about 0.5 inch, at least about 0.75 inch, at least about 1 inch, at least about 1.25 inches, at least about 1.5 inches, at least about 1.75 inches, at least about 2 inches, about 0.5 inch to about 2 inches, about 0.5 inch to about 1 inch, about 1 inch to about 1.5 inches, or about 1.5 inches to about 2 inches.

The lid 70 also may include a cap 78 removably secured or securable to the urine disposal port 76. FIG. 1A shows the cap 78 secured to the urine disposal port 76 in closed position such that the urine disposal port 76 is closed and fluid in the storage container 90 cannot pass through the urine disposal port 76. The cap 78 also may include a cavity 77 sized to receive and mate with a portion of the vacuum port 74 when the adapter 80 is removed from the vacuum port 74. For example, FIG. 1C shows the lid 70 with the cap 78 in the open position. When in the open position, the user or caregiver may prefer to keep the cap 78 from interfering with fluids being poured through the urine disposal port 76. The cap 78, then, may replace the adapter 80 and be detachably secured to the vacuum port 74 by inserting a portion of the vacuum port 74 into the cavity 77 of the cap 78, as shown in FIG. 1C. In FIG. 1C, the cavity 77 in the cap 78 holding a portion of the vacuum port 74 therein is facing downwards and not visible, while the portion of the cap 78 that receives the rim of the urine disposal port 76 is facing upwards and visible. When detachably secured to the vacuum port 74, the cap 78 also may prevent urine or other fluids from leaking out of the vacuum port 74 when the storage container 90 is tipped. A strap 79 may secure the cap 78 to the urine disposal port 76 when the cap 78 is in the open position, with the strap 79 either being secured directly to the urine disposal port 76 or removably secured to the urine disposal port 76 with an o-ring. The cap 78 may include an overhanging flap 75 that allows the user or caregiver to either push the tab to open the urine disposal port 76 or allows the user or caregiver to grasp the cap 78 to open the urine disposal port 76. In some embodiments, the cap 78 may include a flap pivotably secured to the lid 70.

To empty a storage container 70, the conduit 60 and a conduit fluidly coupling the storage container 90 to a fluid collection device are both disconnected from the lid 70. FIG. 1C also shows how a user or caregiver 150 may utilize the handle accessory 100 to transport a storage container 90, though during transport of the storage container 90, the cap 78 is typically in a closed position (shown in FIG. 1A). In FIG. 1C, the bottom end of the storage container 90 is visible extending from the second end 130 of the sleeve 105 and the storage container 90 is visible through the elongated opening 102 of the sleeve 105. The handle accessory 100 allows a user to grasp the handle 110 and more easily carry the storage container 90, which may be heavy if full of fluid. The handle accessory 100 also is beneficial to emptying the storage container 90, as the handle accessory 100 allows for a more controlled tipping of the storage container 90. With the cap 78 in the open position shown in FIG. 1C, urine and other fluids in the storage container may be emptied from the storage container 90 via the urine disposal port 76.

Figure 2:
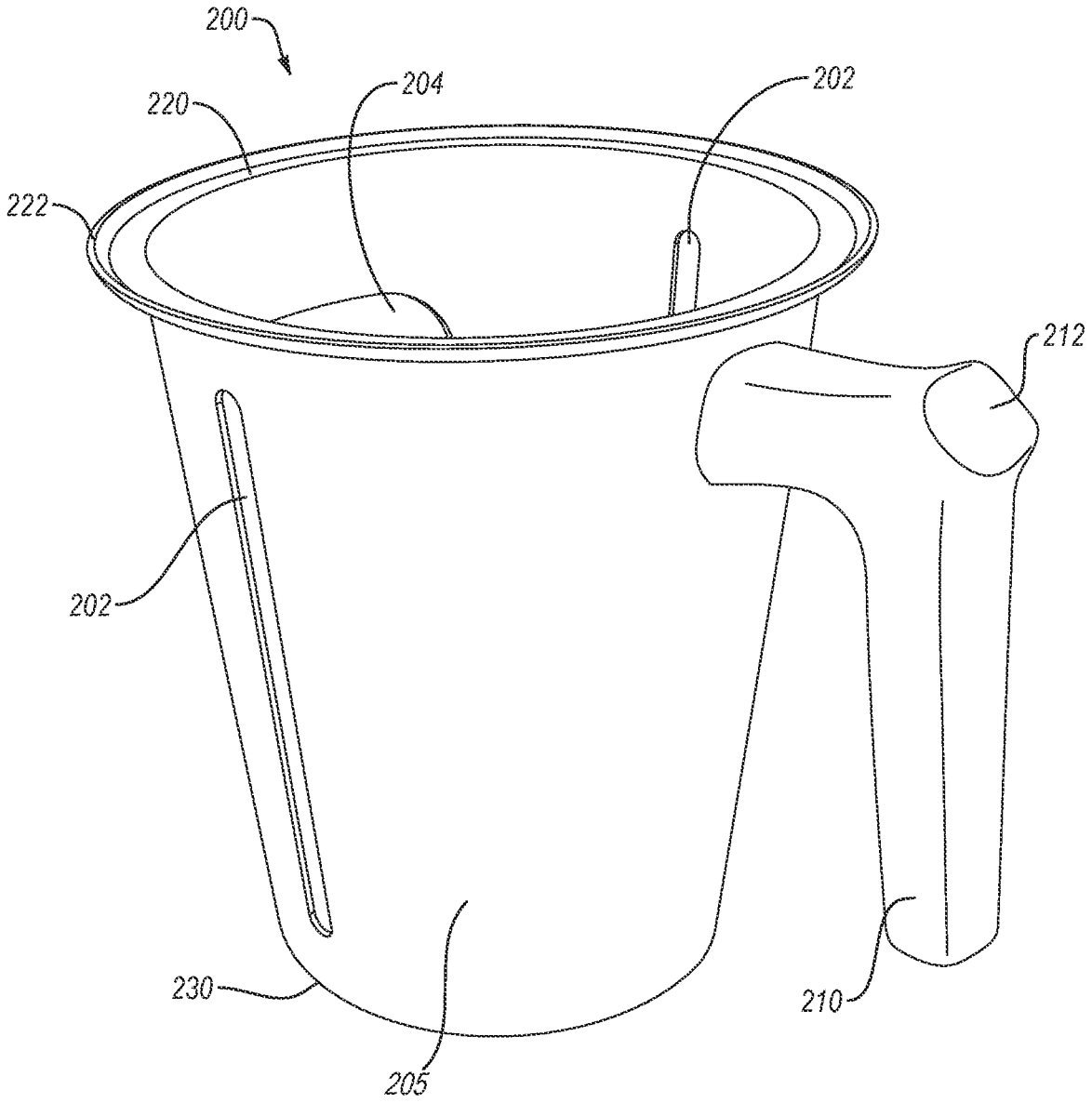
FIG. 2 is an isometric view of a urine storage container handle accessory, according to an embodiment.

FIG. 2 is an isometric view of a handle accessory 200, according to an embodiment. Unless otherwise noted, the handle accessory 200 may include any aspect of the handle accessory 100 described above. For example, the handle accessory 200 includes a sleeve 205 having a first end region 220 and a second end region 230, elongated openings 202, a gap 204, and/or an outward protruding flange 222 that include aspects of the sleeve 105 having the first end region 120 and the second end region 130, the elongated openings 102, the gap 104, and/or an outward protruding flange 122 described above.

The handle accessory 200 also includes a handle 210. Unless otherwise noted, the handle 210 may include any aspect of the handle 110 described above. The handle 210 includes an L-shaped handle 210 secured to the sleeve 205 proximate to the first end region 220 of the sleeve 205. The handle 210 may be secured to the sleeve 205 between the two elongated openings 202 and generally opposite to the gap 204. The handle 210 also may include a thumb grip 212 on a corner of the handle 210.

Figure 3A:
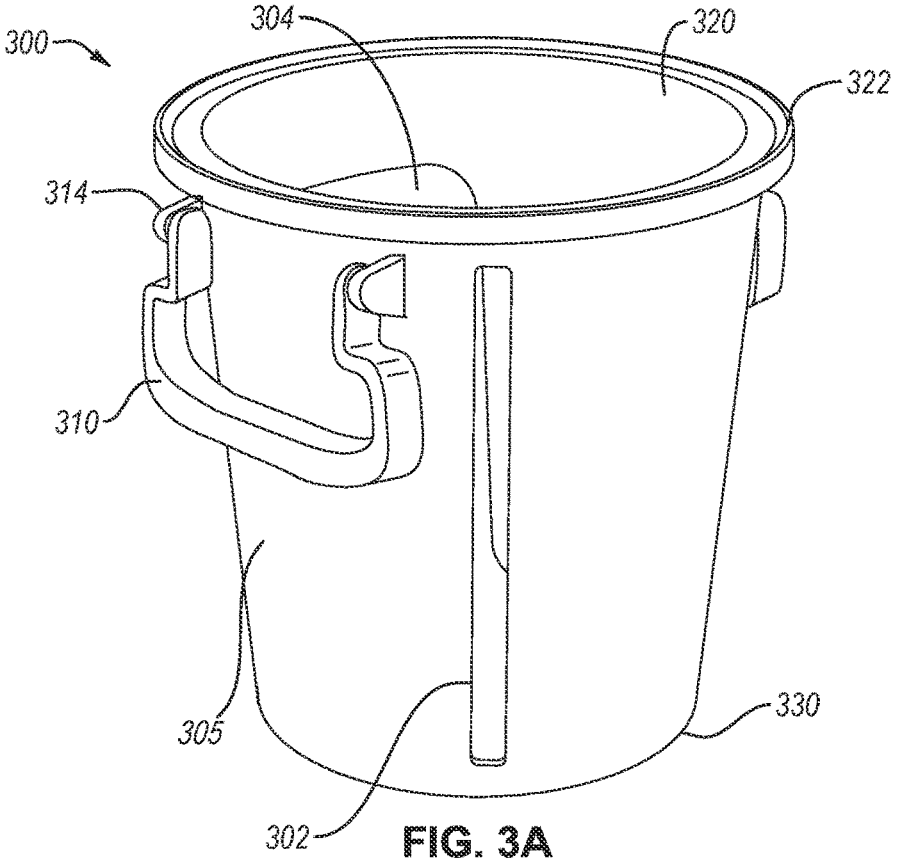
FIG. 3A is an isometric view of a urine storage container handle accessory with handles in a first position, according to an embodiment.
Figure 3B:
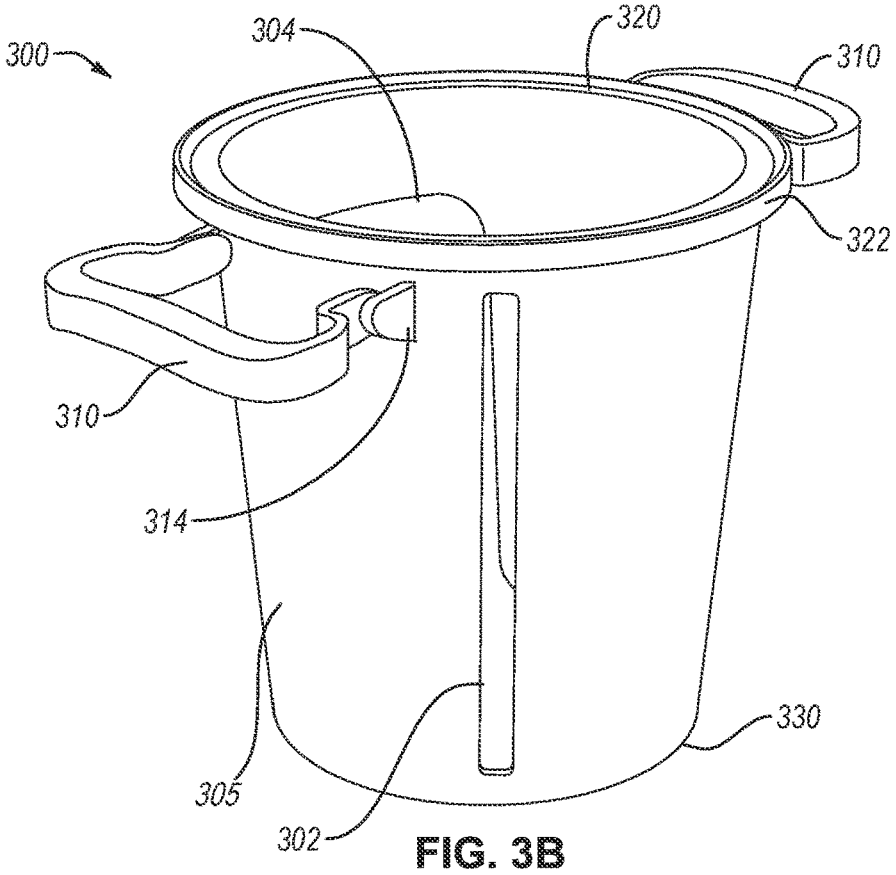
FIG. 3B is an isometric view of the urine storage container handle accessory of FIG. 3A with the handles in a second position.
Figure 3C:
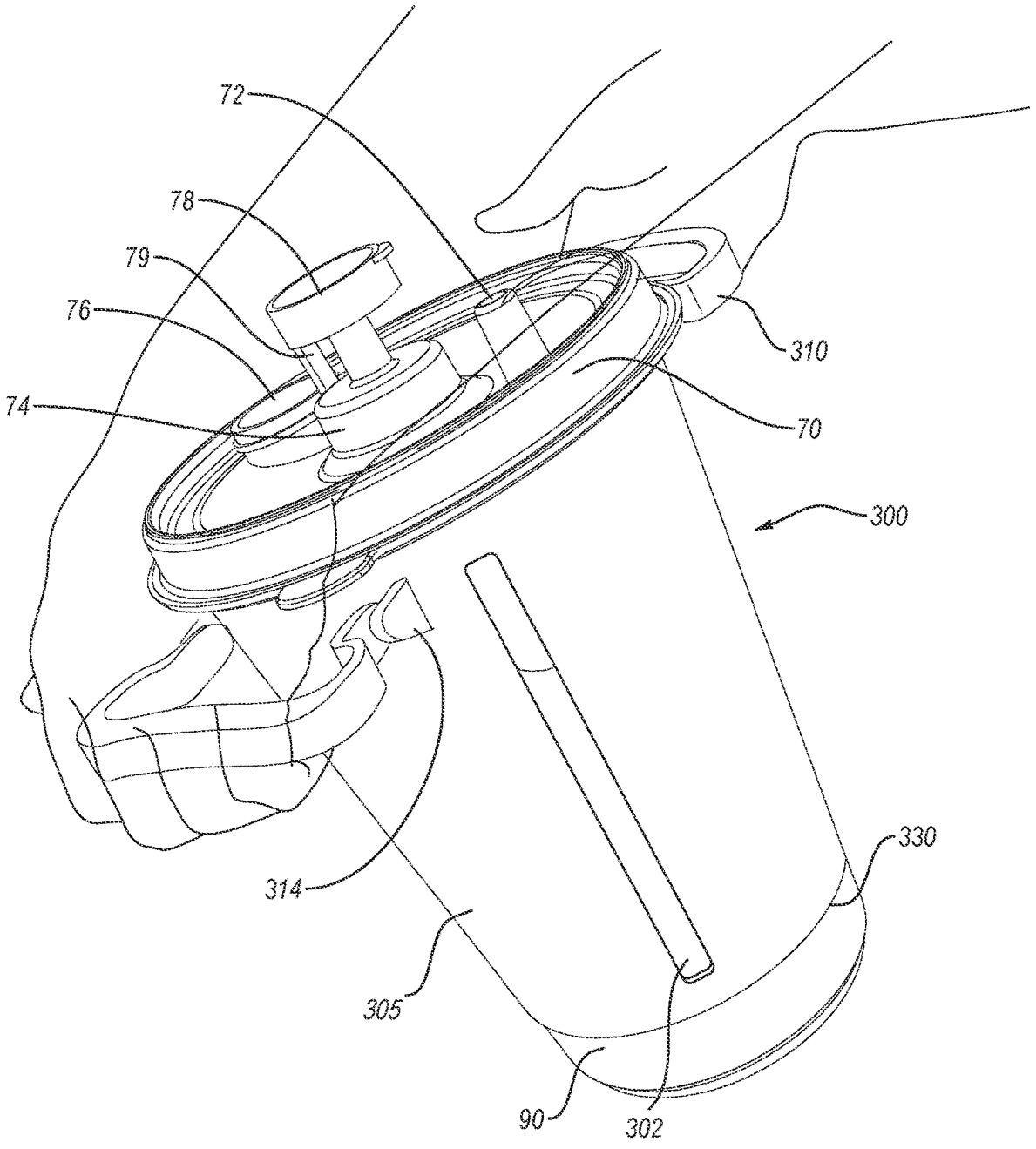
FIG. 3C is an isometric view of the urine storage container handle accessory of FIG. 3A in use.

FIGS. 3A-3C are views of a handle accessory 300, according to an embodiment. Unless otherwise noted, the handle accessory 300 may include any aspect of the handle accessory 100 described above. For example, the handle accessory 300 includes a sleeve 305 having a first end region 320 and a second end region 330, an elongated opening 302, a gap 304, and/or an outward protruding flange 322 that include aspects of the sleeve 105 having the first end region 120 and the second end region 130, the elongated openings 102, the gap 104, and/or an outward protruding flange 122 described above.

The handle accessory 300 also includes two handles 310. Unless otherwise noted, the handles 310 may include any aspect of the handles 110, 210 described above. The handles 310 include two C- or U-shaped handles 310 pivotably or hingedly secured to supports 314 on opposing portions of the sleeve 305 proximate to the first end region 320 of the sleeve 305. Each handle 310 may be secured to the sleeve 305 between the elongated opening 302 and the gap 304. FIG. 3A shows the handles 310 in a downward position, or how the handles 310 may rest when the handle accessory 300 is mated with a storage container 90 on the portable vacuum system 52. FIG. 3B shows the handles 310 having pivoted to an angled position relative to the downward position shown in FIG. 3A. As shown in FIG. 3C, with the handles 310 in an angled position, a user or caregiver may use the handle accessory 300 to carry and/or tip the storage container 90. In some embodiments, the supports 314 and/or the handles 310 may include a tab configured to prevent the handles 310 from pivoting past a desired angled position. Though not shown in FIGS. 3A-3C, in some embodiments the handles 310 rotate to an upright position and may include one or more locking tabs (described in greater detail below in relation to the sleeve 500) configured to lock the lid 70 in place on the storage container 90.

Figure 4:
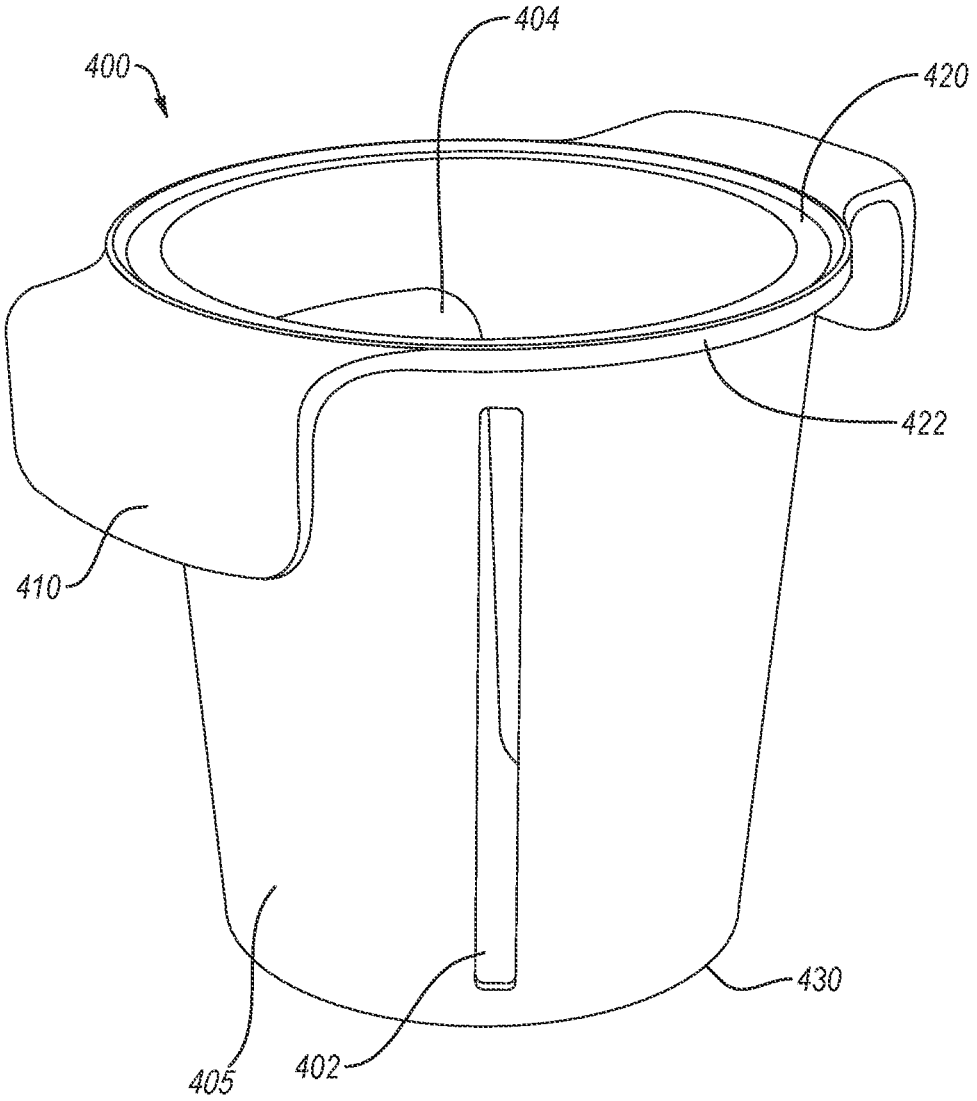
FIG. 4 is an isometric view of a urine storage container handle accessory, according to an embodiment.

FIG. 4 is an isometric view of a handle accessory 400, according to an embodiment. Unless otherwise noted, the handle accessory 400 may include any aspect of the handle accessory 100 described above. For example, the handle accessory 400 includes a sleeve 405 having a first end region 420 and a second end region 430, elongated openings 402, a gap 404, and/or an outward protruding flange 422 that include aspects of the sleeve 105 having the first end region 120 and the second end region 130, the elongated openings 102, the gap 104, and/or an outward protruding flange 122 described above.

The handle accessory 400 also includes two handles 410. Unless otherwise noted, the handle 410 may include any aspect of the handles 110, 210, 310 described above. The handles 410 include an L-shaped handles 410 secured to the flange 422 of the sleeve 405 proximate to the first end region 420. Each handle 410 may be secured to the sleeve 405 between the elongated opening 402 and the gap 404.

Figure 5A:
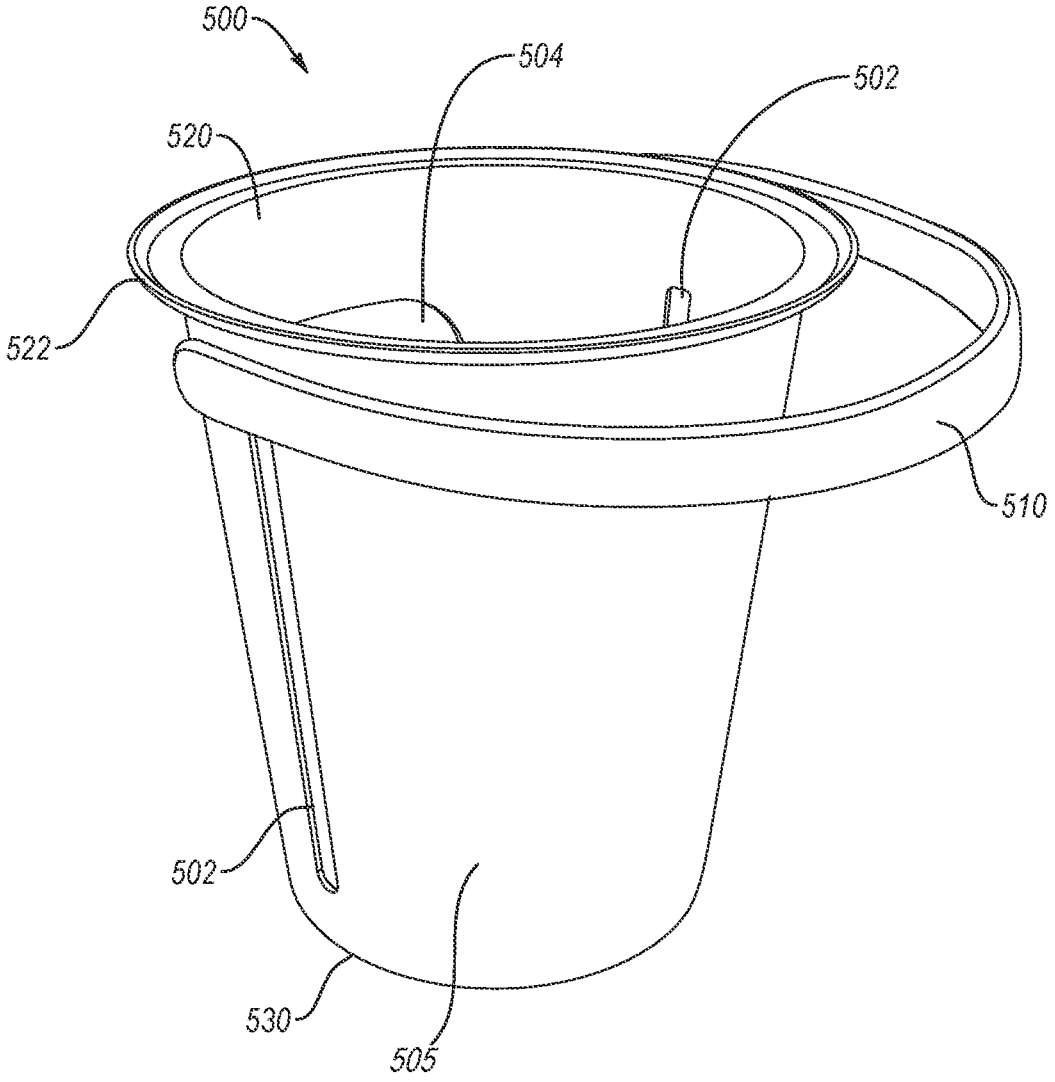
FIG. 5A is an isometric view of a urine storage container handle accessory with a handle in a first position, according to an embodiment.

FIG. 5A is an isometric view of a handle accessory 500, according to an embodiment. Unless otherwise noted, the handle accessory 500 may include any aspect of the handle accessory 100 described above. For example, the handle accessory 500 includes a sleeve 505 having a first end region 520 and a second end region 530, elongated openings 502, a gap 504, and/or an outward protruding flange 522 that include aspects of the sleeve 105 having the first end region 120 and the second end region 130, the elongated openings 102, the gap 104, and/or an outward protruding flange 122 described above.

The handle accessory 500 also includes a handle 510. Unless otherwise noted, the handle 510 may include any aspect of the handles 110, 210, 310, 410 described above. The handle 510 includes a single C- or U-shaped handle 510 pivotably or hingedly secured to the sleeve 505 on opposing portions of the first end region 520 of the sleeve 505. In some embodiments, the handle 510 may be secured to the sleeve 505 with each end of the handle 510 proximate to or aligned with the elongated openings 502. The sleeve 505 may include a latch or slot configured to receive a portion of the handle 505 to pivotably secure the handle 510 to the sleeve 505.

Figure 5B:
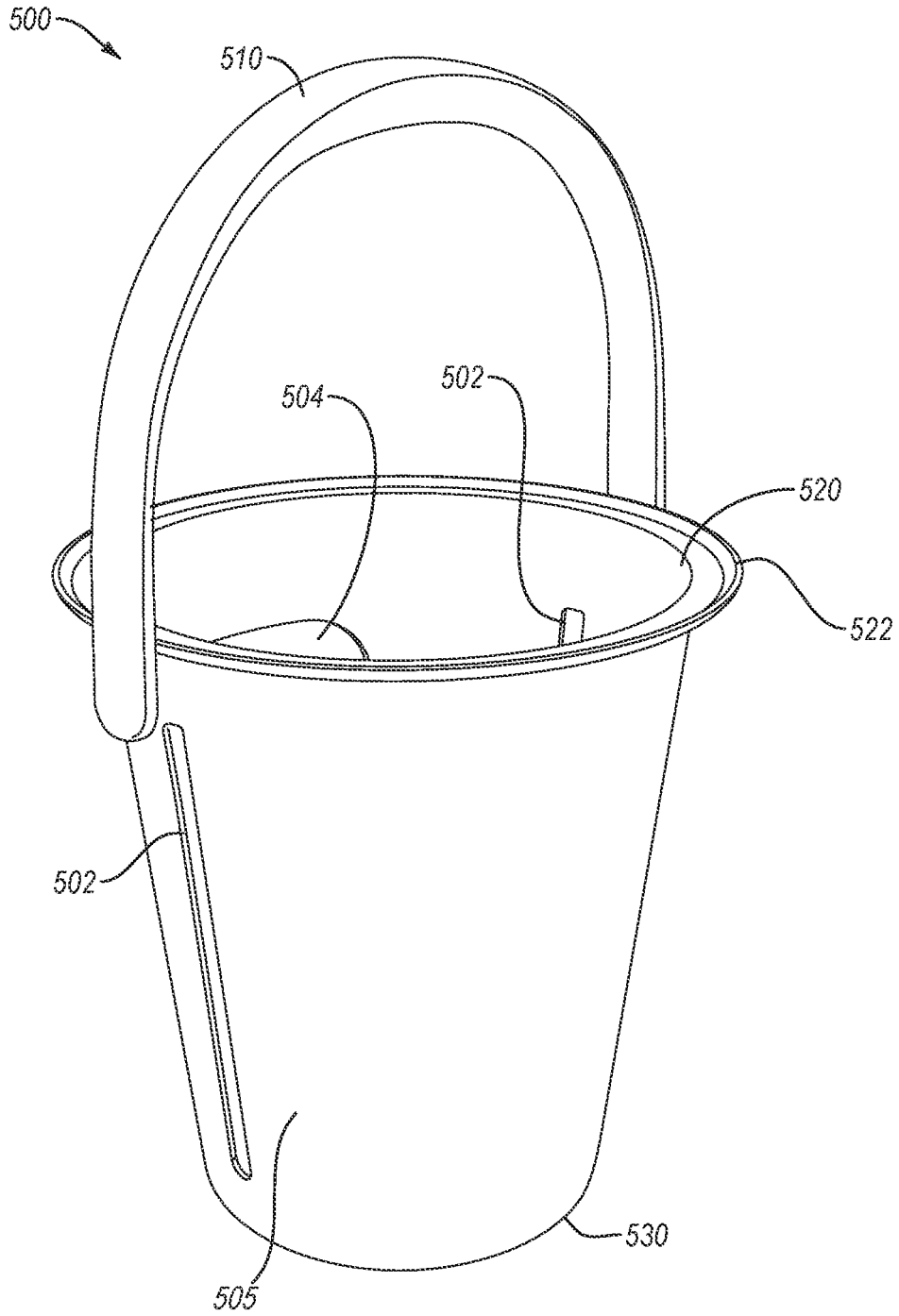
FIG. 5B is an isometric view of the urine storage container handle accessory of FIG. 5A with the handle in a second position.
Figure 5C:
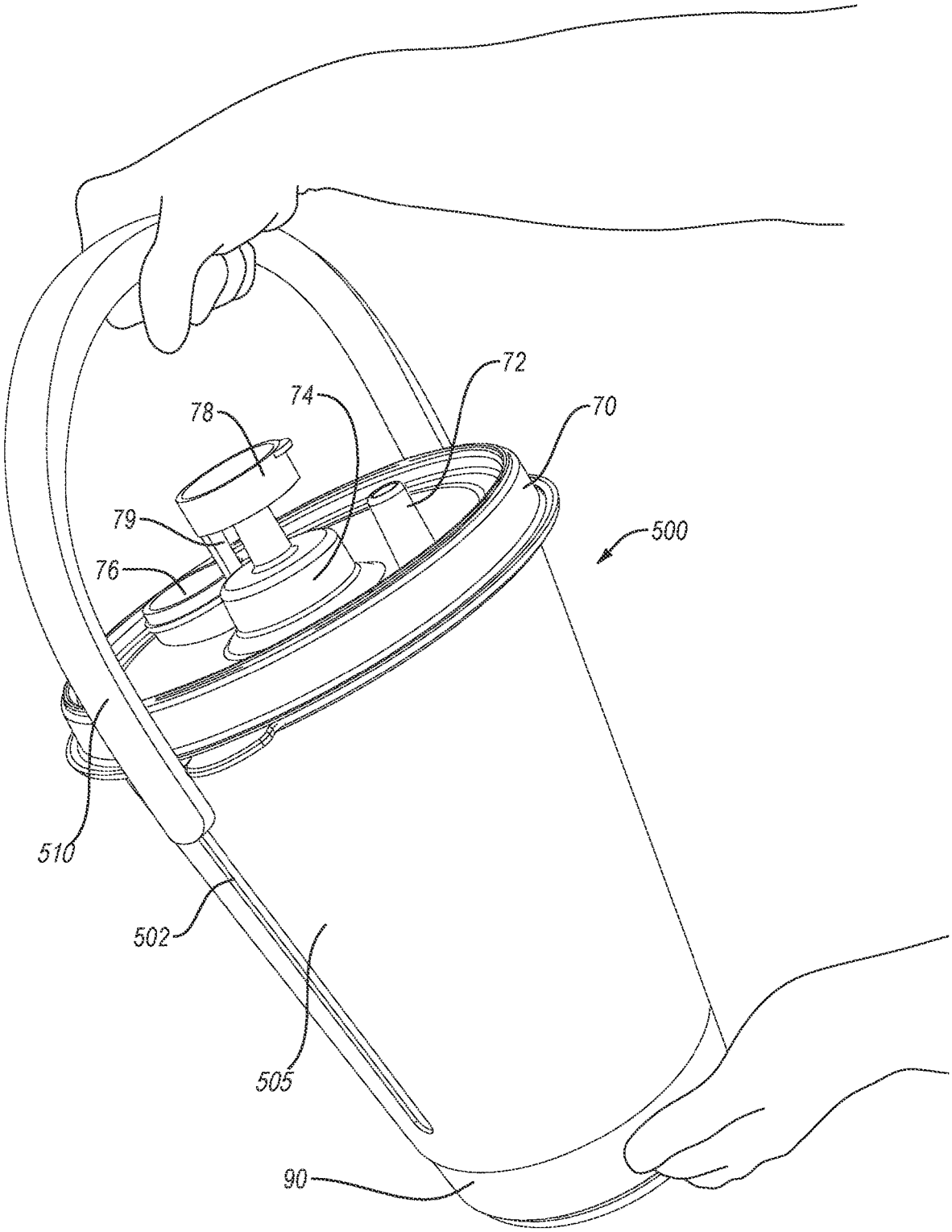
FIG. 5C is an isometric view of the urine storage container handle accessory of FIG. 5A in use.

FIG. 5A shows the handle 510 in an intermediate position between a downward position resting on or against the sleeve 505 and an upright position. FIG. 5B shows the handle 510 having pivoted to an angled or upright position relative to the intermediate position shown in FIG. 5A. In some embodiments, the handle 510 also may include one or more locking tabs (not shown) positioned on the handle 510 to lock the lid 70 in place when the handle 510 is in the upright position. FIG. 5C shows the handle accessory 500 in use with the urine storage container 90 and the lid 70 secured to the urine storage container 90, with a user carrying the assembly using the handle 510.

Figure 6A:
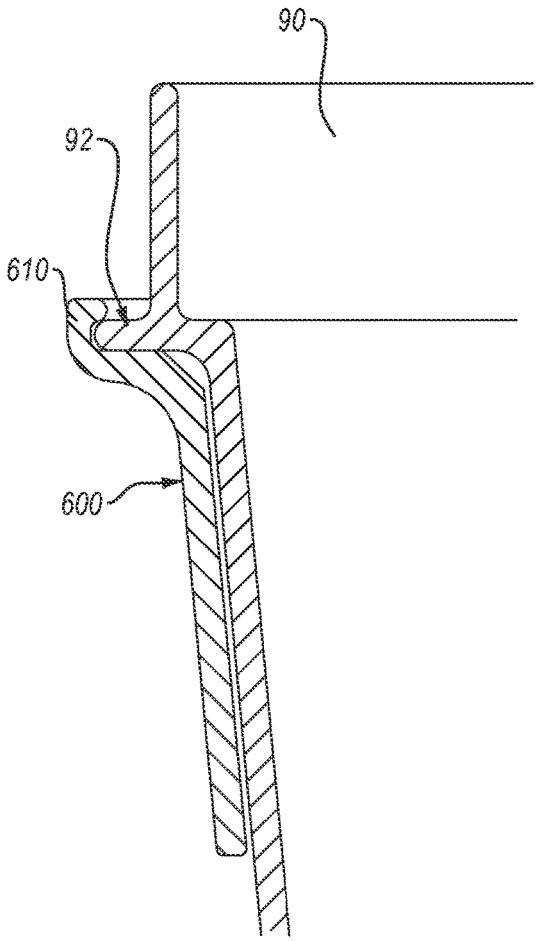
FIG. 6A is a partial cross-sectional view of a urine storage container handle accessory and a urine storage container, according to an embodiment.

FIG. 6A is a cross-sectional view of a portion of a storage container 90 and a portion of a handle accessory 600. Any of the handle accessories 100, 200, 300, 400, 500 may include any aspect of the handle accessory 600 described below. The storage container 90 includes an outward protruding lip 92, and the handle accessory 600 includes a sleeve 605 and an outwardly protruding flange 622. The flange 622 may include a first portion 622*a* adjacent to the sleeve 605 that interfaces the lip 92 of the storage container 90. The flange 622 also may include a second portion 622*b* angled upward from the first portion 622*a*. The second portion 622*b* may include a tab and at least partially define a channel that mates with at least a portion of the lip 92 such that the lip 92 and the flange 622 form a snap joint configured to releasably secure at least the portion of the lip 92 of the storage container 90 to the handle accessory 600. The second portion 622*b* may extend entirely around the first portion 622*a* and/or the sleeve 605, or the second portion 622*b* may extend only partially around the first portion 622 and/or the sleeve 605 at one or more regions. The snap joint or snap fit of at least a portion of the lip 92 and the second portion 622*b* of the flange 622 prevents or inhibits the storage container 90 from slipping out of the sleeve 605 as the storage container 90 is tilted and emptied. In some embodiments, the flange 122 may be absent, and the sleeve 605 may include a locking tab at the top, first end of the sleeve 605 configured to releasably secure to the lip 92 of the storage container 90 and prevent the sleeve 605 from sliding down the storage container 90, such as the handle accessory 670 shown in FIG. 6C.

Figure 6B:
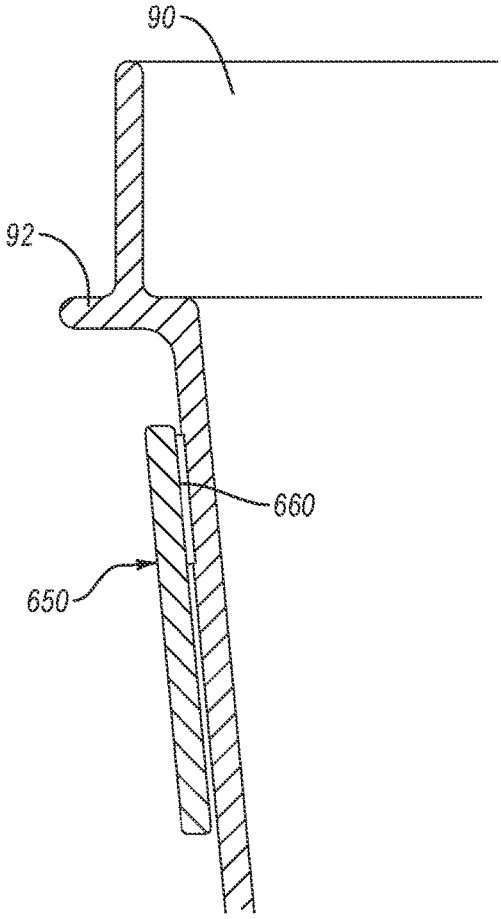
FIG. 6B is a partial cross-sectional view of a urine storage container handle accessory and a urine storage container, according to an embodiment.

FIG. 6B is a cross-sectional view of a portion of a storage container 90 and a portion of a handle accessory 650. Any of the handle accessories 100, 200, 300, 400, 500 may include any aspect of the handle accessory 650 described below. The handle accessory 650 includes at least a sleeve 655 having one or more rubber portions 660 on an inner surface of the sleeve 650. The one or more rubber portions 660 may include rubber beading. The one or more rubber portions 660 are configured stick to the outer surface of the storage container 90 effective to prevent or inhibit the storage container 90 from slipping out of the sleeve 605 as the storage container 90 is tilted and emptied.

Figure 6C:
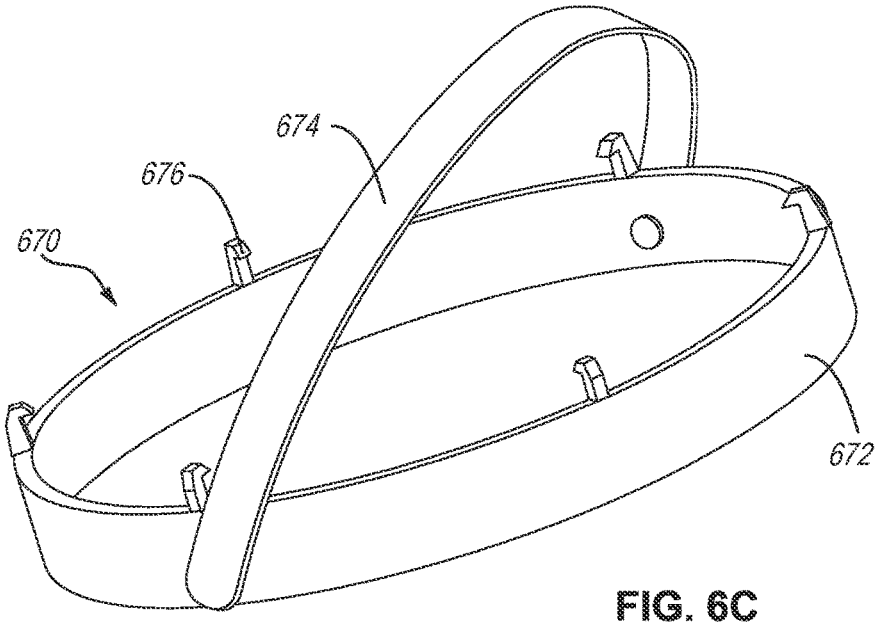
FIG. 6C is an isometric view of a urine storage container handle accessory, according to an embodiment.

FIG. 6C is an isometric view of a handle accessory 670 including a sleeve 672, a handle 674 pivotably secured to the sleeve 672, and a plurality of locking tabs 676 extending from the sleeve 672. The plurality of locking tabs 676 are sized and configured to releasable secure to lip the lip 92 of the storage container 90 and prevent the sleeve 672 from sliding down the storage container 90. The plurality of locking tabs 676 may include six locking tabs 676 positioned on a top edge of the sleeve 672. In other embodiments, the handle accessory 670 may include one, two, three, four, five, or seven or more locking tabs 672 positioned on the top edge of the sleeve 672. In some embodiments, the plurality of locking tabs 672 may extend from an outer periphery of the sleeve 672. The plurality of tabs 672 also may be included on the handle accessories 100, 200, 300, 400, 500, or 600.

The sleeve 672 of the handle accessory 670 may include any aspect of the sleeves 105, 205, 305, 405, 600, 650 disclosed herein. In some embodiments, the handle accessory 670 includes a length of less than about 2 inches, less than about 1 inch, or about 0.5 inch to about 2 inches. The handle 674 includes a U- or C-shaped handle 674 pivotably or hingedly secured to the sleeve 672 on opposing portions of the sleeve 672. In some embodiments, the handle 674 may include any aspect of the handles 110, 210, 310, 410, 510 disclosed herein.

Figure 7:
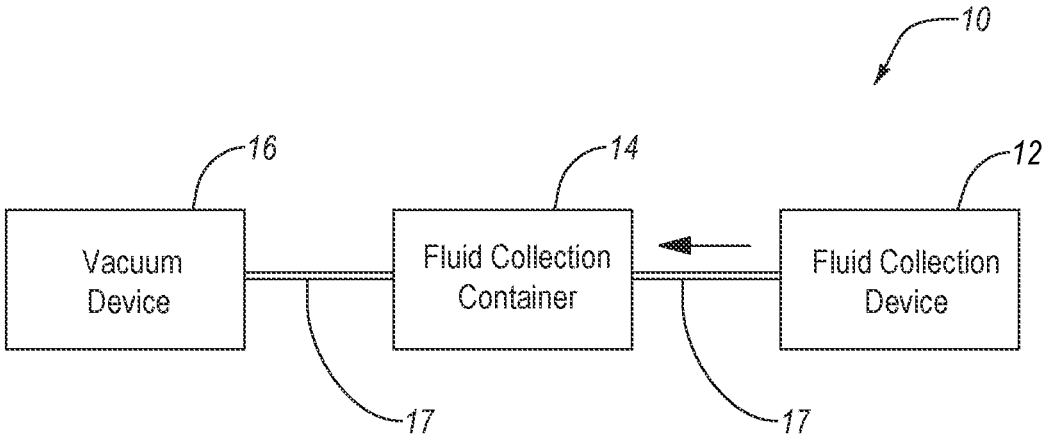
FIG. 7 is a block diagram of a system for urine storage, according to an embodiment.

FIG. 7 is a block diagram of a system 10 for fluid storage, according to an embodiment. The system 10 includes a fluid collection device 12, a fluid storage container 14, and a portable vacuum source 16. The fluid collection device 12 may include at least one of any of the handle accessories or the lid accessories described herein. The fluid collection device 12, the fluid storage container 14, and the portable vacuum source 16 may be fluidly coupled to each other via one or more conduits 17. For example, the fluid collection device 12 may be fluidly coupled to the fluid storage container 14 through the port 72, and the portable vacuum source 16 may be fluidly coupled to the fluid storage container 14 through the port 74. The conduit 17 may include any of the conduits described herein, such as conduit 60. The fluid collection device 12 may be operably coupled to one or more of the fluid storage container 14 or the portable vacuum source via the conduit 17. Fluid (e.g., urine or other bodily fluids) collected in the fluid collection device 12 may be removed from the fluid collection device 12 via the conduit 17, which protrudes into an interior region of the fluid collection device 12. For example, a first open end of the conduit 17 may extend into the fluid collection device 12 to a reservoir therein. The second open end of the conduit 17 may extend into the fluid storage container 14 or the portable vacuum source 16. The suction force may be introduced into the interior region of the fluid collection device 12 via the first open end of the conduit 17 responsive to a suction (e.g., vacuum) force applied at the second end of the conduit 17. The suction force may be applied to the second open end of the conduit 17 by the portable vacuum source 16 either directly or indirectly.

The suction force may be applied indirectly via the fluid storage container 14. For example, the second open end of the conduit 17 may be disposed within the fluid storage container 14 and an additional conduit 17 may extend from the fluid storage container 14 to the portable vacuum source 16. Accordingly, the portable vacuum source 16 may apply suction to the fluid collection device 12 via the fluid storage container 14. The suction force may be applied directly via the fluid storage container 14. For example, the second open end of the conduit 17 may be disposed within the portable vacuum source 16. An additional conduit 17 may extend from the portable vacuum source 16 to a point outside of the fluid collection device 12, such as to the fluid storage container 14. In such examples, the portable vacuum source 16 may be disposed between the fluid collection device 12 and the fluid storage container 14. The fluid collection device 12 may be shaped and sized to be positioned adjacent to a urethra.

In some embodiments, the fluid storage container 14 may include a bottle or cup (e.g., collection jar), or any other enclosed container for storing bodily fluids such as urine. In examples, the conduit 17 may extend from the fluid collection device 12 and attach to the fluid storage container 14 at a first point therein, such as the port 72. An additional conduit 17 may attach to the fluid storage container 14 at a second point thereon, such as the port 74, and may extend and attach to the portable vacuum source 16. For example, the fluid storage container 14 may include a container fluidly coupled to a first conduit section that is also fluidly coupled to the fluid collection member of the fluid collection device 12. The container may be fluidly coupled to a second section of the conduit 17 that is also fluidly coupled to a portable vacuum source. In such examples, the portable vacuum source 16 may provide a vacuum/suction through the container to the fluid collection member to provide suction in the chamber of the fluid collection member. Accordingly, a vacuum (e.g., suction) may be drawn through fluid collection device 12 via the fluid storage container 14. As the fluid is drained from the chamber, the fluid may travel through the first section of conduit to the fluid storage container where it may be retained. Fluid, such as urine, may be drained from the fluid collection device 12 using the portable vacuum source 16.

In some embodiments, the portable vacuum source 16 may be disposed in or on the fluid collection device 12. In such examples, the conduit 17 may extend from the fluid collection device and attach to the portable vacuum source 16 at a first point therein. An additional conduit 17 may attach to the portable vacuum source 16 at a second point thereon and may extend out of the fluid collection device 12, and may attach to the fluid storage container 14. Accordingly, a vacuum (e.g., suction) may be drawn through fluid collection device 12 via the fluid storage container 14.

The portable vacuum source 16 may include one or more of a manual vacuum pump, and electric vacuum pump, a diaphragm pump, a centrifugal pump, a displacement pump, a magnetically driven pump, a peristaltic pump, or any pump configured to produce a vacuum. The portable vacuum source 16 may provide a vacuum or suction to remove fluid from the fluid collection member of the fluid collection device 12. In some embodiments, the portable vacuum source 16 may be powered by one or more of a power cord (e.g., connected to a power socket), one or more batteries, or even manual power (e.g., a hand operated vacuum pump). In examples, the portable vacuum source 16 may be sized and shaped to fit outside of, on, or within the fluid collection device 12. For example, the portable vacuum source 16 may include one or more miniaturized pumps or one or more micro pumps. In some embodiments, the vacuum source 16 includes a stationary vacuum source, such as a wall-mounted vacuum source. The portable vacuum sources 16 disclosed herein may include one or more of a switch, a button, a plug, a remote, or any other device suitable to activate the portable vacuum source 16. It should be understood that the portable vacuum sources 16 disclosed herein may provide a portable means of providing a suction or vacuum that allows use of the devices and systems herein outside of hospital or care facility environments where vacuum lines are plumbed into patient rooms or large (e.g., larger or heavier than a patient can readily carry) vacuum sources are located. For example, a portable vacuum source may be small and light enough to be carried by a user (e.g., patient) or aid (e.g., nurse) during transportation of the user.

Figure 8:
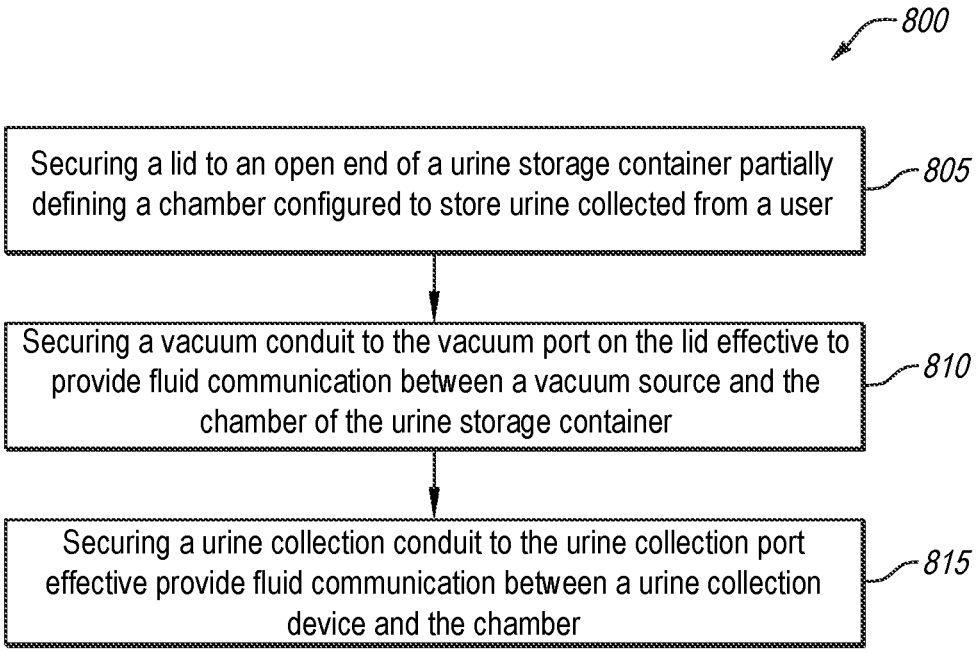
FIG. 8 is a flow diagram of a method of assembling a urine storage system for storing and disposing of urine collected from a user.

FIG. 8 is a flow diagram of a method 800 of assembling a urine storage system for storing and disposing of urine collected from a user. The method 800 may include any system described herein. In an embodiment, the method 800 includes an act 805 of securing a lid to an open end of a urine storage container at least partially defining a chamber configured to store urine collected from a user. The lid includes a vacuum port, a urine collection port, a urine disposal port sized and dimensioned to pour the urine in the urine storage container therethrough, and a cap secured to the urine disposal port. The method 800 includes an act 810 of securing a vacuum conduit to the vacuum port on the lid effective to provide fluid communication between a vacuum source and the chamber of the urine storage container. The method 800 includes an act 815 of securing a urine collection conduit to the urine collection port effective provide fluid communication between a urine collection device and the chamber such that urine collected from the user enters the chamber of the urine storage container through the urine collection port when the vacuum source is activated.

In some embodiments, the method 800 includes an act of inserting at least a first portion of the urine storage container into a sleeve of a handle accessory. The sleeve may be shaped complementary to at least the first portion of the urine storage container and include at least one handle. The method 800 also may include an act of positioning a second portion of the urine storage container in a base having a recessed portion sized and shaped complementary to the second portion of the urine storage container. The vacuum source may include a portable vacuum source housed by a body that includes that base. In some embodiments, the sleeve includes at least one elongated opening extending at least partially between the first end region and the second end region. The sleeve may include an outer periphery and a gap in the outer periphery extending longitudinally from the second end region at least halfway to the first end region and extending at least about 75 degrees around the outer periphery of the sleeve. In some embodiments, the at least one handle may include a single handle positioned substantially opposite to the gap and the sleeve may include two elongated openings positioned substantially opposite to one another between the gap and the single handle. The at least one handle may include a single handle pivotably secured to the opposing portions of the first end region of the sleeve. In some embodiments, the at least one handle may include two handles positioned opposite to one another, the gap may be positioned between the two handles, and/or the at least one elongated opening may be positioned between the two handles distal to the gap. The two handles may be pivotably secured to the sleeve.

In some embodiments, the method 800 may include an act of snap fitting one or more tabs on the sleeve around at least a portion of an outward protruding lip on the urine storage container. In these and other embodiments, the act of inserting the urine storage container into a sleeve of a handle accessory may include inserting the urine storage container into the sleeve of the handle accessory until the outward protruding lip interfaces an outward protruding flange on the handle accessory. The sleeve may include one or more rubber surfaces on an inner portion of the sleeve positioned to interface the urine storage container. In some embodiments, the method 800 may include an act of engaging a locking tab on the sleeve with a lip on the storage container.

Acts 805, 810, and 815 of the method 800 are for illustrative purposes. For example, the act 805, 810, and 815 of the method 800 may be performed in different orders, split into multiple acts, modified, supplemented, or combined. In an embodiment, one or more of the acts 805, 810, and 815 of the method 800 may be omitted from the method 800. Any of the acts 805, 810, and 815 may include using any of the fluid collection devices or systems disclosed herein.

As used herein, the term "about" or "substantially" refers to an allowable variance of the term modified by "about" by ±10% or ±5%. Further, the terms "less than," "or less," "greater than", "more than," or "or more" include as an endpoint, the value that is modified by the terms "less than," "or less," "greater than," "more than," or "or more."

While various aspects and embodiments have been disclosed herein, other aspects and embodiments are contemplated. The various aspects and embodiment disclosed herein are for purposes of illustration and are not intended to be limiting.

What is claimed is:

1. A urine storage assembly for storing and disposing of urine collected from a user, the urine storage assembly comprising:

a urine storage container configured to store urine collected from the user and having an open end and a closed end distal to the open end;

a lid secured or securable to the open end of the urine storage container, the lid including a vacuum port configured to attach to a vacuum conduit in fluid communication with a vacuum source, a urine collection port configured to attach to a urine collection conduit in fluid communication with a urine collection device such that urine collected from the user enters the urine storage container through the urine collection port when the vacuum source is activated, a urine disposal port sized and dimensioned to pour urine in the urine storage container therethrough when the lid is secured to the urine storage container, and a cap secured or securable to the urine disposal port; and a handle accessory including a sleeve and at least one handle, the sleeve being shaped and sized complimentary to at least a portion of the urine storage container.

2. The urine storage assembly of claim 1, wherein:

the urine storage container tapers at least partially between the open end and the closed end; and the sleeve of the handle system includes a first end region, a second end region, an outer periphery, at least one elongated opening extending at least partially between the first end region and the second end region, and a gap in the outer periphery extending longitudinally from the second end region at least halfway to the first end region and extending at least about 75 degrees around the outer periphery of the sleeve, the sleeve tapering between the first end region and the second end region complementary to urine storage container.

3. The urine storage assembly of claim 2, wherein the at least one handle includes a single handle positioned substantially opposite to the gap and the sleeve includes two elongated openings positioned substantially opposite to one another between the gap and the single handle.

4. The urine storage assembly of claim 2, wherein the at least one handle includes a single handle pivotably secured to the opposing portions of the first end region of the sleeve.

5. The urine storage assembly of claim 2, wherein the at least one handle includes two handles positioned opposite to one another, the gap is positioned between the two handles, and the at least one elongated opening is positioned between the two handles distal to the gap.

6. The urine storage assembly of claim 5, wherein the two handles are pivotably secured to the sleeve.

7. The urine storage assembly of claim 6, wherein at least one handle of the two handles includes a locking tab and is pivotable from an unlocked position to a locked position, the locking tab being configured to engage with the lid effective to releasably lock the lid on the urine storage container when the at least one handle is in the locked position.

8. The urine storage assembly of claim 1, wherein:

the urine storage container includes an outward protruding lip proximate to the open end; and the handle accessory includes an outward protruding flange proximate to the first end region and interfacing the lip of the urine storage container.

9. The urine storage assembly of claim 8, wherein the sleeve includes one or more rubber surfaces on an inner portion of the sleeve positioned to interface the urine storage container.

10. The urine storage assembly of claim 8, wherein the first end region of the sleeve includes one or more tabs configured to snap fit around at least a portion of the lip of the urine storage container.

11. The urine storage assembly of claim 1, wherein the urine disposal port defines an opening having a diameter of about 1 inch to about 1.5 inches.

12. The urine storage assembly of claim 1, wherein the cap is configured to close the urine disposal port in a closed position and close the second port in an open position.

13. The urine storage assembly of claim 1, further comprising a locking tab on the sleeve engaged with a lip on the storage container.

14. A urine storage system for storing and disposing of urine collected from a user, the urine storage system comprising:

a urine storage container at least partially defining a chamber configured to store urine collected from the user and having an open end and a closed end distal to the open end;

a lid secured or securable to the open end of the urine storage container, the lid including a vacuum port, a urine collection port, a urine disposal port sized and dimensioned to pour the urine in the urine storage container therethrough when the lid is secured to the urine storage container, and a cap secured or securable to the urine disposal port;

a vacuum conduit in fluid communication with a vacuum source and attached to the vacuum port effective to provide fluid communication between the vacuum source and the chamber of the urine storage container; and a urine collection conduit in fluid communication with a urine collection device and attached to the urine collection port effective to provide fluid communication between the chamber and the urine collection device such that urine collected from the user enters the chamber of the urine storage container through the urine collection port when the vacuum source is activated.

15. The urine storage system of claim 14, further comprising:

a base having a recessed portion sized and shaped complementary to the second end of the urine storage container;

a portable vacuum system including a body housing the vacuum source and the base; and a handle accessory including a sleeve and at least one handle, the sleeve being shaped and sized complimentary to at least a portion of the urine storage container.

16. The urine storage system of claim 15, wherein:

the urine storage container tapers at least partially between the open end and the closed end; and the sleeve of the handle system includes a first end region and a second end region, and the sleeve tapers between the first end region and the second end region complementary to urine storage container.

17. The urine storage system of claim 16, wherein:

the sleeve includes at least one elongated opening extending at least partially between the first end region and the second end region; and the sleeve includes an outer periphery and a gap in the outer periphery extending longitudinally from the second end region at least halfway to the first end region and extending at least about 75 degrees around the outer periphery of the sleeve.

18. The urine storage system of claim 17, wherein the at least one handle includes a single handle positioned substantially opposite to the gap and the sleeve includes two elongated openings positioned substantially opposite to one another between the gap and the single handle.

19. The urine storage system of claim 17, wherein the at least one handle includes a single handle pivotably secured to the opposing portions of the first end region of the sleeve.

20. The urine storage system of claim 17, wherein the at least one handle includes two handles positioned opposite to one another, the gap is positioned between the two handles, and the at least one elongated opening is positioned between the two handles distal to the gap.

21. The urine storage system of claim 20, wherein the two handles are pivotably secured to the sleeve.

22. The urine storage system of claim 15, wherein:

the urine storage container includes an outward protruding lip proximate to the open end;

the handle accessory includes an outward protruding flange proximate to the first end region and interfacing the lip of the urine storage container;

the sleeve includes one or more rubber surfaces on an inner portion of the sleeve positioned to interface the urine storage container; and the first end region of the sleeve includes one or more tabs configured to snap fit around at least a portion of the lip of the urine storage container.

23. The urine storage system of claim 15, further comprising a locking tab on the sleeve engaged with a lip on the storage container.

24. The urine storage system of claim 14, wherein the urine disposal port defines an opening having a diameter of about 1 inch to about 1.5 inches.

25. The urine storage system of claim 14, wherein the cap is configured to close the urine disposal port in a closed position and close the second port in an open position.

26. A method of assembling a urine storage system for storing and disposing of urine collected from a user, the method comprising:

securing a lid to an open end of a urine storage container at least partially defining a chamber configured to store urine collected from a user, the lid including a vacuum port, a urine collection port, a urine disposal port sized and dimensioned to pour the urine in the urine storage container therethrough, and a cap secured to the urine disposal port;

securing a vacuum conduit to the vacuum port on the lid effective to provide fluid communication between a vacuum source and the chamber of the urine storage container; and securing a urine collection conduit to the urine collection port effective provide fluid communication between a urine collection device and the chamber such that urine collected from the user enters the chamber of the urine storage container through the urine collection port when the vacuum source is activated.

27. The method of claim 26, further comprising inserting at least a first portion of the urine storage container into a sleeve of a handle accessory, the sleeve being shaped complementary to at least the first portion of the urine storage container and including at least one handle.

28. The method of claim 27, further comprising positioning a second portion of the urine storage container in a base having a recessed portion sized and shaped complementary to the second portion of the urine storage container, wherein the vacuum source includes a portable vacuum source housed by a body that includes that base.

29. The method of claim 27, wherein:

the sleeve includes at least one elongated opening extending at least partially between the first end region and the second end region; and the sleeve includes an outer periphery and a gap in the outer periphery extending longitudinally from the second end region at least halfway to the first end region and extending at least about 75 degrees around the outer periphery of the sleeve.

30. The method of claim 29, wherein the at least one handle includes a single handle positioned substantially opposite to the gap and the sleeve includes two elongated openings positioned substantially opposite to one another between the gap and the single handle.

31. The method of claim 29, wherein the at least one handle includes a single handle pivotably secured to the opposing portions of the first end region of the sleeve.

32. The method of claim 29, wherein the at least one handle includes two handles positioned opposite to one another, the gap is positioned between the two handles, and the at least one elongated opening is positioned between the two handles distal to the gap.

33. The method of claim 32, wherein the two handles are pivotably secured to the sleeve.

34. The method of claim 27, further comprising:

snap fitting one or more tabs on the sleeve around at least a portion of an outward protruding lip on the urine storage container; and wherein inserting the urine storage container into a sleeve of a handle accessory includes inserting the urine storage container into the sleeve of the handle accessory until the outward protruding lip interfaces an outward protruding flange on the handle accessory, the sleeve including one or more rubber surfaces on an inner portion of the sleeve positioned to interface the urine storage container.

35. The method of claim 27, further comprising engaging a locking tab on the sleeve with a lip on the storage container.

* * * * *